US009276343B2

(12) United States Patent
Nakamura

(10) Patent No.: US 9,276,343 B2
(45) Date of Patent: Mar. 1, 2016

(54) CONNECTOR AND TERMINAL WITH INSULATOR SEPARATING AND INSULATING FIRST AND SECOND TERMINALS IN A DIRECTION PERPENDICULAR TO A MATING DIRECTION

(71) Applicant: Japan Aviation Electronics Industry, Limited, Tokyo (JP)

(72) Inventor: Keisuke Nakamura, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 14/541,257

(22) Filed: Nov. 14, 2014

(65) Prior Publication Data

US 2015/0200478 A1 Jul. 16, 2015

(30) Foreign Application Priority Data

Jan. 10, 2014 (JP) ..... 2014-003321

(51) Int. Cl.

*H01R 24/00* (2011.01)
*H01R 12/88* (2011.01)
*H01R 12/72* (2011.01)
(Continued)

(52) U.S. Cl.

CPC ..... *H01R 12/88* (2013.01); *H01R 12/724* (2013.01); *H01R 12/73* (2013.01); *H01R 13/514* (2013.01)

(58) Field of Classification Search

CPC ..... H01R 12/724; H01R 13/514
USPC ..... 439/637
See application file for complete search history.

(56) References Cited

U.S. PATENT DOCUMENTS 7,074,049 B2 7/2006 O'Sullivan et al.
7,442,089 B2 * 10/2008 Regnier ..... H01R 13/26 439/637

(Continued)

FOREIGN PATENT DOCUMENTS

JP H05-021118 A 1/1993
JP 2000-100527 A 4/2000
JP 2002-015796 A 1/2002

(Continued)

OTHER PUBLICATIONS

Korean Office Action in KR 10-2014-0160713, dated Dec. 1, 2015, with English translation.

*Primary Examiner* — Tho D Ta
(74) *Attorney, Agent, or Firm* — Collard & Roe, P.C.

(57) ABSTRACT

A terminal is connectable to a connection object having a first mating connection portion and a second mating connection portion. The terminal comprises a first terminal, a second terminal and an insulator. The first terminal has a first contact portion electrically connectable with the first mating connection portion in a first direction. The second terminal has a second contact portion electrically connectable with the second mating connection portion in the first direction. The insulator fixes and integrates the first terminal and the second terminal in a second direction perpendicular to the first direction. When the first contact portion and the second contact portion are connected to the first mating connection portion and the second mating connection portion, respectively, the first terminal is electrically unconnected with the second mating connection portion, and the second terminal is electrically unconnected with the first mating connection portion.

26 Claims, 18 Drawing Sheets

(51) Int. Cl.
*H01R 12/73* (2011.01)
*H01R 13/514* (2006.01)

(56) References Cited

U.S. PATENT DOCUMENTS 8,550,855 B2 * 10/2013 Zhang ..... H01R 13/405
439/636
8,858,237 B2 * 10/2014 Hsu ..... H01R 13/514
439/60

FOREIGN PATENT DOCUMENTS

JP 2005-310762 11/2005
JP 2010-153080 A 7/2010
JP 2013-109994 A 6/2013

* cited by examiner

CONNECTOR AND TERMINAL WITH INSULATOR SEPARATING AND INSULATING FIRST AND SECOND TERMINALS IN A DIRECTION PERPENDICULAR TO A MATING DIRECTION

CROSS REFERENCE TO RELATED APPLICATIONS

An applicant claims priority under 35 U.S.C. §119 of Japanese Patent Application No. JP2014-003321 filed Jan. 10, 2014.

BACKGROUND OF THE INVENTION

This invention relates to a terminal which is to be connected to a connection object such as a printed circuit board and a connector.

For example, this type of terminal is disclosed in JP-A 2002-15796 (Patent Document 1), the content of which is incorporated herein by reference.

As shown in FIG. 35, a clip terminal (terminal) of Patent Document 1 is to be connected to a circuit board (connection object) along a front-rear direction. The clip terminal comprises a plurality of metal pieces and a plurality of resin members (insulators). The metal pieces and the resin members are alternately adhered and fixed to one another in a lateral direction. The circuit board has an upper surface and a lower surface (not shown) each of which is provided with a plurality of terminals (connection portions). When the clip terminal is connected to the circuit board, each of the metal pieces vertically sandwich the circuit board to be electrically connected with the terminal on the upper surface and the terminal on the lower surface.

Recently, for a connection object which is to be connected to a connector, there is a requirement to increase the number of signal lines of the connection object without increasing a size of the connector, in particular, a size of the connector in a pitch direction.

SUMMARY OF THE INVENTION

It is therefore an object of the present invention to provide a terminal having a structure which is capable of satisfying this requirement.

One aspect (first aspect) of the present invention provides a terminal connectable to a connection object having a first mating connection portion and a second mating connection portion oppositely located in a first direction. The terminal comprises a first terminal, a second terminal and an insulator. The first terminal has a first contact portion which is to be electrically connected with the first mating connection portion in the first direction. The second terminal has a second contact portion which is to be electrically connected with the second mating connection portion in the first direction. The insulator fixes and integrates the first terminal and the second terminal in a second direction perpendicular to the first direction while electrically insulating the first terminal and the second terminal from each other. When the first contact portion and the second contact portion are connected to the first mating connection portion and the second mating connection portion, respectively, the first terminal is electrically unconnected with the second mating connection portion, and the second terminal is electrically unconnected with the first mating connection portion.

Another aspect (second aspect) of the present invention provides a connector comprising the terminal according to the first aspect and a housing. The housing is formed with an accommodation portion. The terminal is partially accommodated in the accommodation portion.

According to the first aspect of the present invention, the insulator of the terminal fixes and integrates the first terminal and the second terminal in the second direction perpendicular to the first direction in which each of the first mating connection portion and the second mating connection portion is connected. Accordingly, the first contact portion of the first terminal and the second contact portion of the second terminal can be close to each other in the second direction. Moreover, the first contact portion is connected to the first mating connection portion of the connection object while being unconnected to the second mating connection portion. Similarly, the second contact portion is connected to the second mating connection portion while being unconnected to the first mating connection portion. Accordingly, for example, it is possible to provide the first mating connection portion (connection portion) on an upper surface of the connection object while providing the second mating connection portion (connection portion) on a lower surface of the connection object. In this case, a collection of the terminals according to the first aspect is properly connectable with the connection portions arranged in high density on the upper surface and the lower surface of the connection object.

An appreciation of the objectives of the present invention and a more complete understanding of its structure may be had by studying the following description of the preferred embodiment and by referring to the accompanying drawings.

Figure 1:
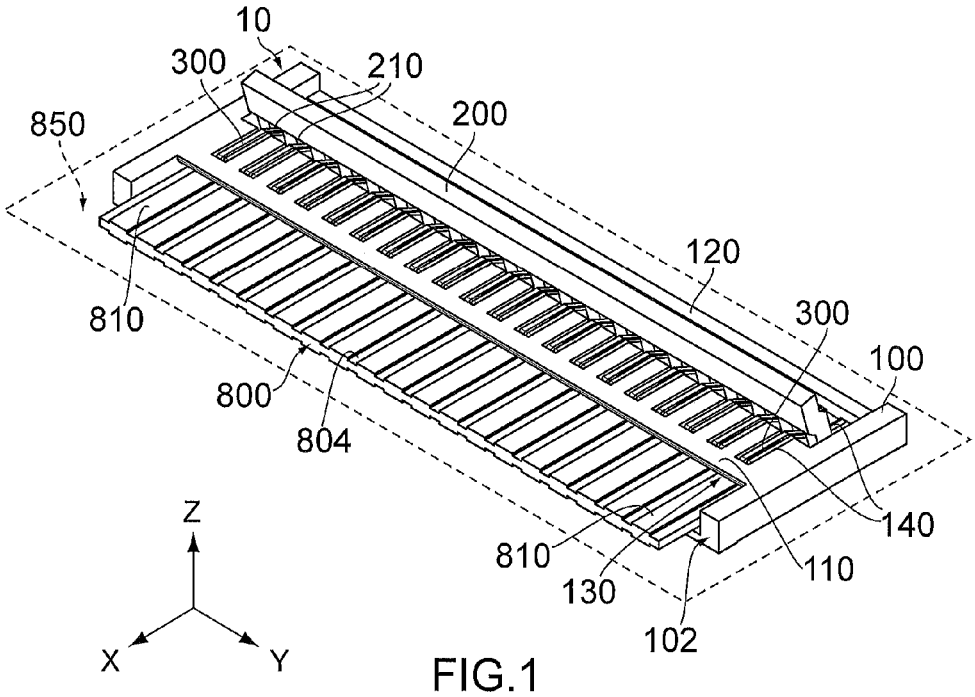
FIG. 1 is a perspective view showing a connector according to a first embodiment of the present invention, wherein a part of a connection object (printed circuit board) to which the connector is fixed is illustrated by dashed line.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS (First Embodiment)

As can be seen from FIGS. 1 to 6, a connector 10 according to a first embodiment of the present embodiment is a on-board connector that is to be mounted and fixed on a fixing object (printed circuit board) 850. In other words, the fixing object, to which the connector 10 according to the present embodiment is to be fixed, is a printed circuit board. However, the present invention is also applicable to a connector other than the on-board connector. The connector 10 is connectable to a connection object (printed circuit board) 800 which is inserted into the connector 10 along the X-direction (front-rear direction, third direction). In other words, the connection object, to which the connector 10 according to the present embodiment is connected when used, is a printed circuit board. However, the connection object according to the present invention does not need to be a printed circuit board.

As can be seen from FIG. 1, the printed circuit board 850 extends along the XY-plane (predetermined plane). The printed circuit board 850 is provided with a plurality of conductive pads (not shown) which are to be connected to the connector 10.

Figure 2:
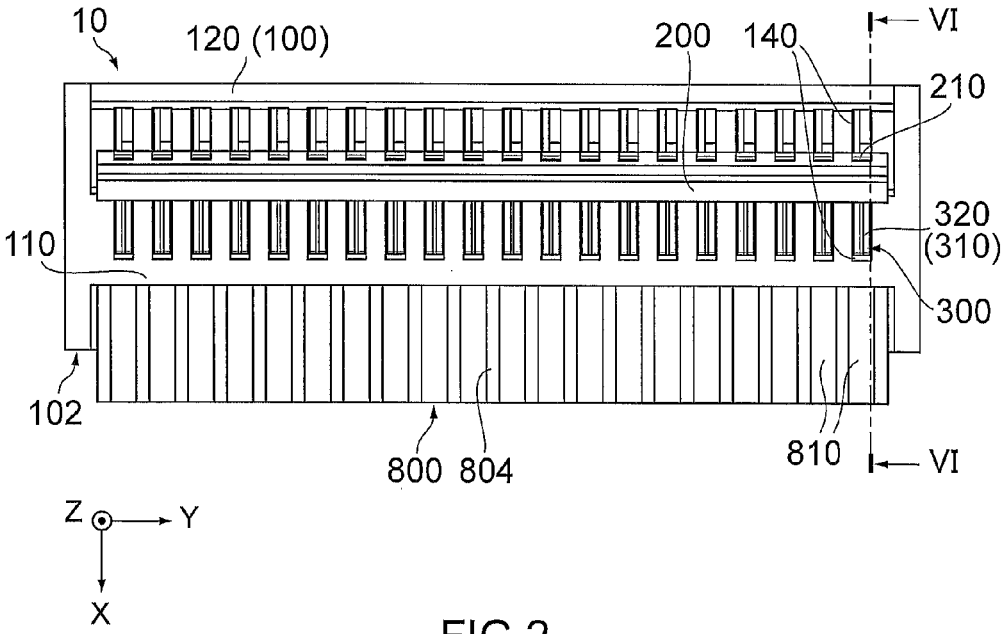
FIG. 2 is a top view showing the connector of FIG. 1.
Figure 5:
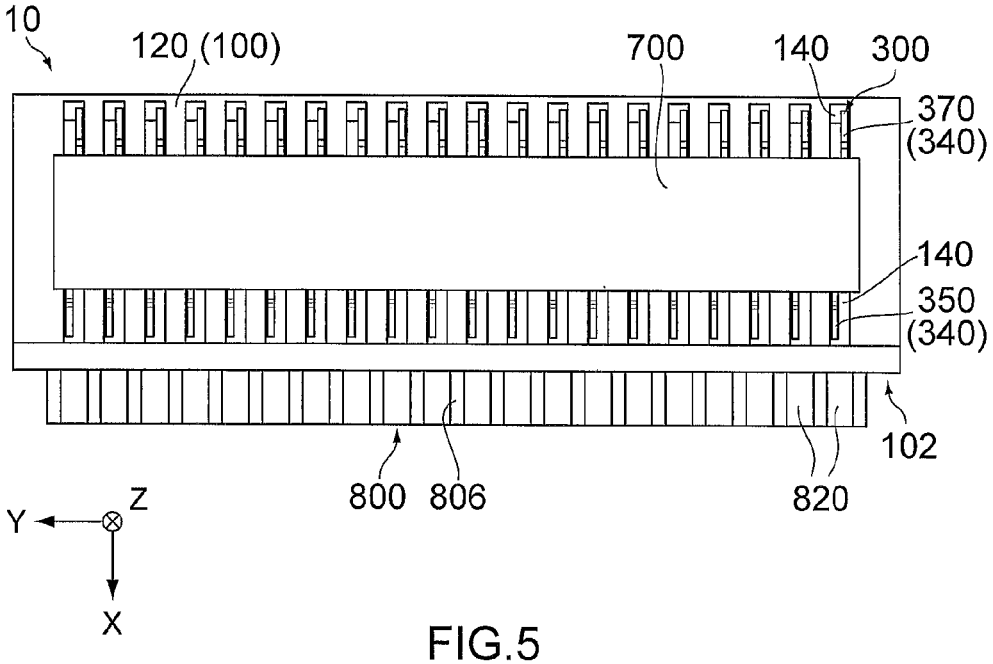
FIG. 5 is a bottom view showing the connector of FIG. 1.
Figure 6:
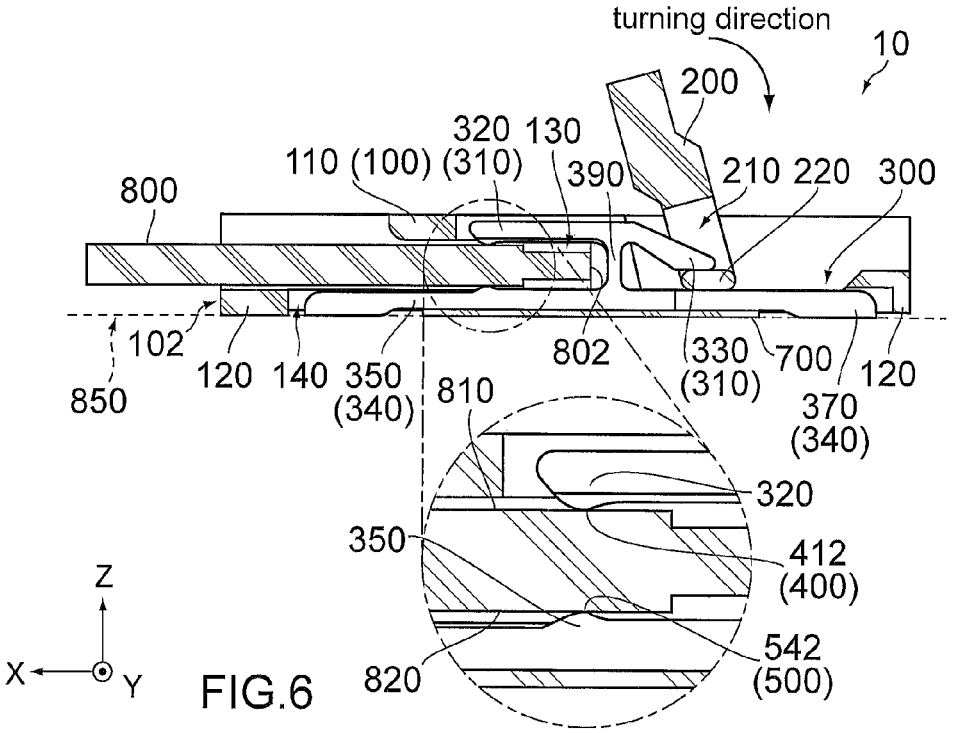
FIG. 6 is a cross-sectional view showing the connector of FIG. 2, taken along line VI-VI, wherein an upper surface of the printed circuit board to which the connector is fixed is illustrated by dashed line, and the vicinity of a first contact portion and a second contact portion of the terminal (a part encircled by chain dotted line) is enlarged to be illustrated.

As shown in FIG. 6, the printed circuit board 800 has a connection end 802 which is to be inserted into the connector 10. Moreover, as shown in FIGS. 2 and 5, the printed circuit board 800 has an upper surface 804 and a lower surface 806 in the Z-direction (upper-lower direction, first direction). The upper surface 804 is provided with a plurality of first mating connection portions (conductive pads) 810 while the lower surface 806 is provided with a plurality of second mating connection portions (conductive pads) 820. Accordingly, the conductive pads 810 and the conductive pads 820 are oppositely located on the printed circuit board 800 in the Z-direction. The conductive pads 810 are located in the vicinity of the connection end 802 to be arranged in the Y-direction (pitch direction, second direction). Similarly, the conductive pads 820 are located in the vicinity of the connection end 802 to be arranged in the Y-direction. The conductive pads 810 are connected to the respective upper signal lines (not shown) of the printed circuit board 800. The conductive pads 820 are connected to the respective lower signal lines (not shown) of the printed circuit board 800, wherein the lower signal lines are different from the upper signal lines.

As shown in FIGS. 1 to 6, the connector 10 according to the present embodiment includes a housing 100 made of an insulating material, an actuator 200 made of an insulating material, a plurality of terminals 300 and an insulation sheet 700 made of an insulating material.

Figure 3:
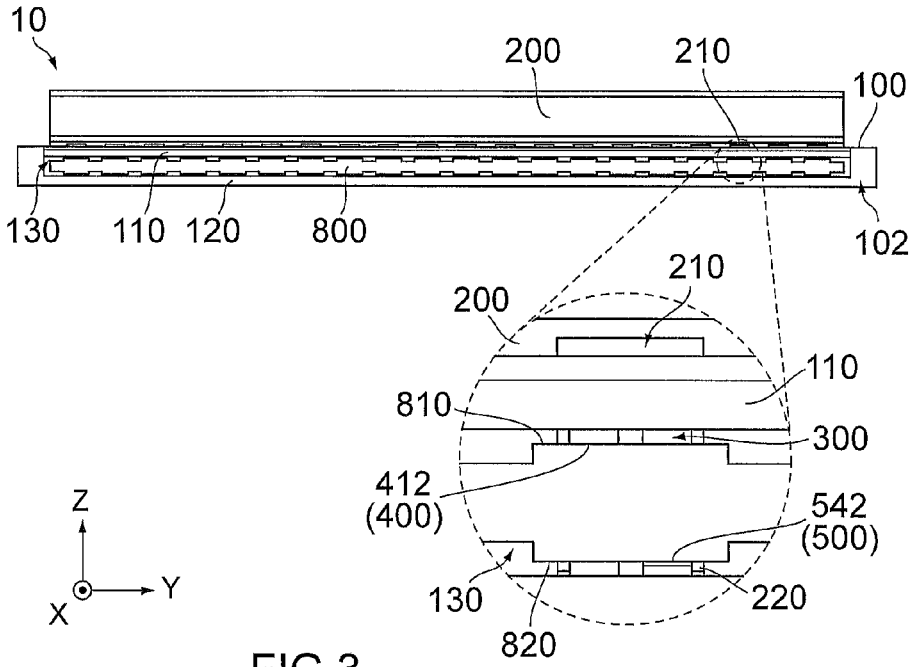
FIG. 3 is a front view showing the connector of FIG. 1, wherein the vicinity of a terminal of the connector (a part encircled by dashed line) is enlarged to be illustrated.

As shown in FIGS. 1 to 3, the housing 100 has a plate-like shape extending long in the Y-direction and has a front end 102 in the X-direction. The housing 100 has an upper plate 110 and a bottom plate 120. The upper plate 110 is located at an upper part of the housing 100 to extend long in the Y-direction while the bottom plate 120 is located at a lower part of the housing 100 to extend long in the Y-direction.

As shown in FIGS. 1, 2, 5 and 6, the housing 100 is formed with a receive portion 130 and a plurality of accommodation portions 140. The receive portion 130 is a space located between the upper plate 110 and the bottom plate 120 in the Z-direction. The receive portion 130 receives the connection end 802 of the printed circuit board 800 which is inserted from the front end 102 of the connector 10. Each of the accommodation portions 140 is a space which pierces the upper plate 110 and the bottom plate 120 in the Z-direction. The accommodation portions 140 are arranged in the Y-direction. The accommodation portions 140 accommodate the terminals 300 which are inserted thereinto from below, respectively. In other words, each of the terminals 300 is partially accommodated in a corresponding one of the accommodation portions 140. The lower end (negative Z-side ends) of the accommodation portion 140 that accommodates the terminal 300 is partially covered by the insulation sheet 700 (see FIG. 5).

Figure 7:
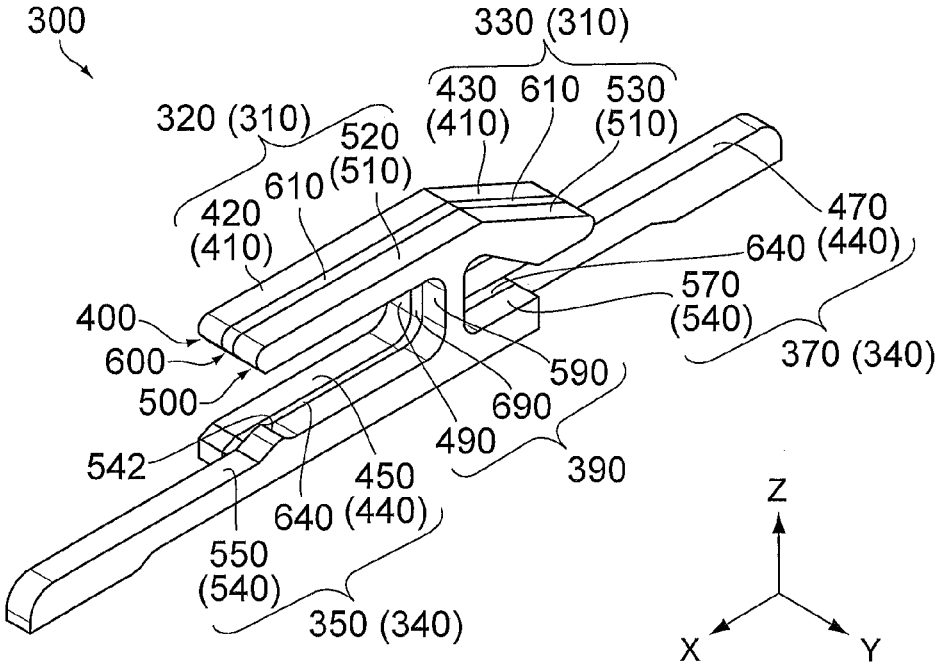
FIG. 7 is an upper perspective view showing the terminal according to the first embodiment of the present invention.

As shown in FIGS. 6 and 7, each of the terminals 300 has an upper portion 310, a lower portion 340 and a coupling portion 390. The upper portion 310 and the lower portion 340 extend along the X-direction. The coupling portion 390 couples an upper middle part of the upper portion 310 and a lower middle part of the lower portion 340 with each other in the Z-direction, wherein the upper middle part is located at the middle of the upper portion 310 in the X-direction, and the lower middle part is located at the middle of the lower portion 340 in the X-direction.

The upper portion 310 of the terminal 300 has a first connection portion 320 and a pushed-up portion 330. The first connection portion 320 extends forward (in the positive X-direction) from the coupling portion 390 while the pushed-up portion 330 extends rearward (in the negative X-direction) from the coupling portion 390. Similarly, the lower portion 340 has a second connection portion (second fixed portion) 350 and a first fixed portion 370. The second connection portion 350 extends forward from the coupling portion 390 while the first fixed portion 370 extends rearward from the coupling portion 390.

As can be seen from FIG. 6, a part located in the vicinity of a front end (positive X-side end) of the second connection portion 350 and a part located in the vicinity of a rear end (negative X-side end) of the first fixed portion 370 are to be connected and fixed to the conductive pads (not shown) of the printed circuit board 850 by soldering or the like. When the lower portion 340, or the second connection portion 350 and the first fixed portion 370, is fixed to the printed circuit board 850, the upper portion 310 is resiliently deformable in the XZ-plane so as to pivot about the coupling portion 390. In other words, each of the first connection portion 320 and the pushed-up portion 330 is resiliently deformable in the XZ-plane.

Figure 4:
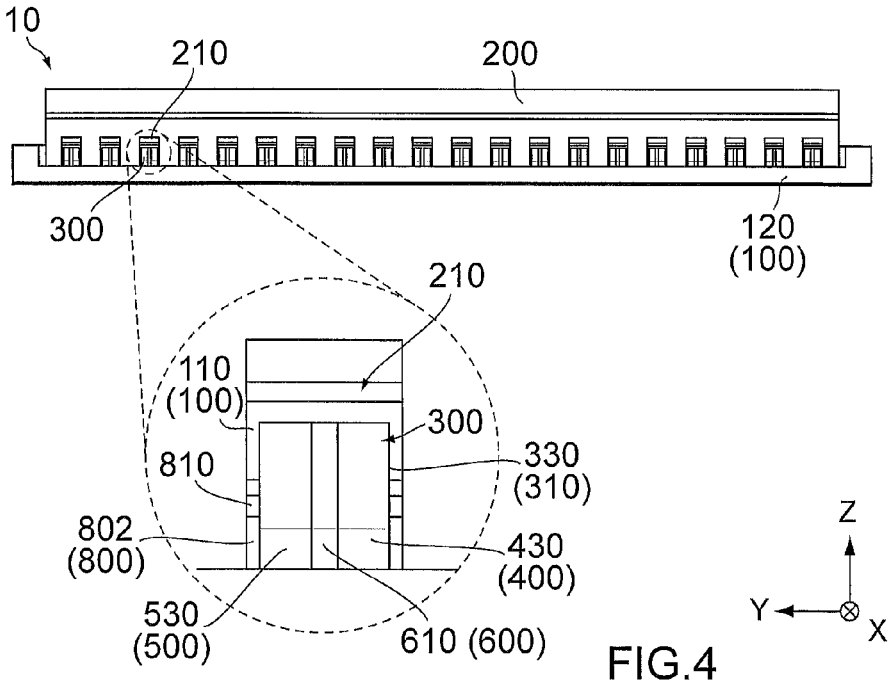
FIG. 4 is a rear view showing the connector of FIG. 1, wherein the vicinity of the terminal (a part encircled by dashed line) is enlarged to be illustrated.

As shown in FIGS. 3, 4 and 6, the actuator 200 has a plate-like shape extending long in the Y-direction (longitudinal direction). The actuator 200 is formed with a plurality of slits 210 and a plurality of push-up portions 220. Each of the slits 210 pierces the actuator 200 in a thickness direction. The slits 210 are provided to correspond to the accommodation portions 140 of the housing 100, respectively. Moreover, the push-up portions 220 are provided to correspond to the slits 210, respectively. Each of the push-up portions 220 is located at an end of the actuator 200 in a width direction perpendicular to the longitudinal direction to extend roughly along the thickness direction of the actuator 200.

As shown in FIG. 6, the actuator 200 is placed on the housing 100 so that the push-up portions 220 are located at a lower end of the actuator 200 to extend along the X-direction. When the actuator 200 is placed as described above, each of the slits 210 is located at a position same as that of the corresponding accommodation portion 140 of the housing 100 in the Y-direction. Accordingly, the pushed-up portion 330 of the terminal 300 accommodated in the accommodation portion 140 is located on the push-up portion 220 of the actuator 200.

When the connection end 802 of the printed circuit board 800 is received in the receive portion 130 of the connector 10, the terminals 300 are connected to the printed circuit board 800. In detail, the first connection portion 320 and the second connection portion 350 of the terminal 300 are electrically connected with the conductive pad 810 and the conductive pad 820, respectively. When the actuator 200 is turned in a turning direction (see FIG. 6) under this state, the pushed-up portion 330 is lifted upward (in the positive Z-direction) so that the first connection portion 320 is pressed against the conductive pad 810. The first connection portion 320 and the second connection portion 350 sandwich the conductive pad 810 and the conductive pad 820 in the Z-direction to securely keep connection between the terminal 300 and the printed circuit board 800.

The connector 10 according to the present embodiment can be modified variously. For example, the accommodation portion 140 may be a recess recessed downward (in the negative Z-direction). In this case, the insulation sheet 700 does not need to be provided. The terminal 300 may be press-fit and accommodated in the accommodation portion 140 of the housing 100. Moreover, the terminal 300 may not have the pushed-up portion 330. In other words, the actuator 200 may not be provided.

In short, the connector according to the present invention may be formed in any way, provided that the connector can accommodate, at least in part, the terminal according to the present invention.

Hereafter, explanation is made further in detail about the terminal 300 according to the present embodiment.

Figure 8:
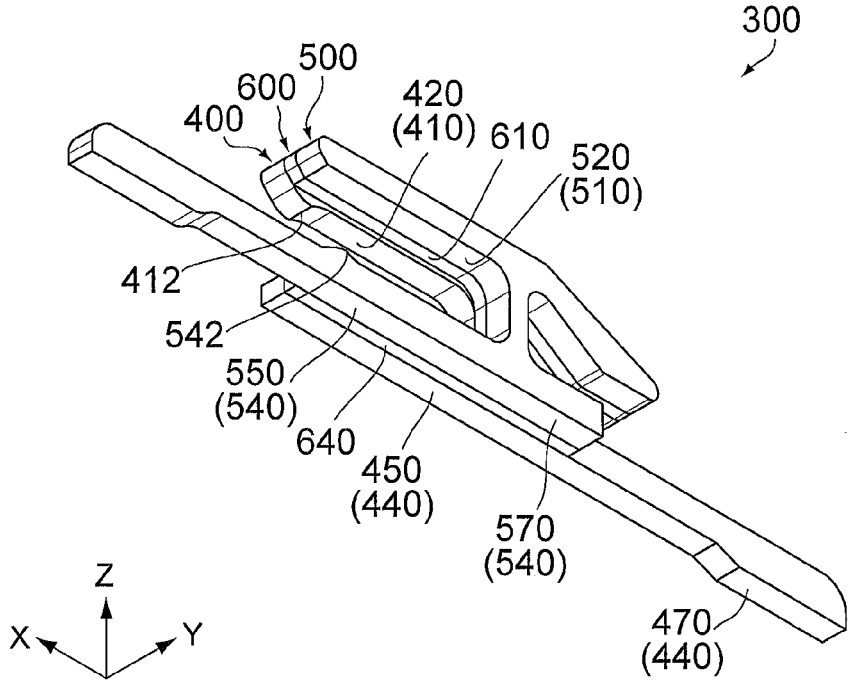
FIG. 8 is a lower perspective view showing the terminal of FIG. 7.

As shown in FIGS. 7 and 8, the terminal 300 includes a first terminal 400 made of a conductor, a second terminal 500 made of a conductor and an insulator 600 made of an insulating material such as a resin. Each of the first terminal 400, the second terminal 500 and the insulator 600 extends on a plane perpendicular to the Y-direction (pitch direction, second direction).

The first terminal 400 is fixed to one of sides (negative Y-side) of the insulator 600 in the Y-direction (second direction) via a fusing process while the second terminal 500 is fixed to a remaining one of the sides (positive Y-side) of the insulator 600 in the Y-direction via the fusing process. In other words, the insulator 600 is fused between the first terminal 400 and the second terminal 500 in the Y-direction to fix and integrate the first terminal 400 and the second terminal 500. Moreover, the insulator 600 electrically insulates the first terminal 400 and the second terminal 500 from each other. Accordingly, the terminal 300 includes the two terminals, namely, the first terminal 400 and the second terminal 500, which are slightly apart from each other in the Y-direction and insulated from each other. The thus-formed terminal 300 can be formed, for example, by fusing and fixing a thin resin plate between two metal sheets and subsequently partially punching out a section.

According to the present embodiment, the first terminal 400 is located at the negative Y-side of the terminal 300 while the second terminal 500 is located at the positive Y-side of the terminal 300. However, the first terminal 400 may be located at the positive Y-side of the terminal 300 while the second terminal 500 may be located at the negative Y-side of the terminal 300. Moreover, the first terminal 400 and the second terminal 500 may be fixed to the insulator 600 without fusing the insulator 600.

As shown in FIGS. 7 and 8, according to the present embodiment, the first terminal 400, the second terminal 500 and the insulator 600 have their basic structures similar to one another. In detail, the first terminal 400 has an upper portion 410, a lower portion 440 and a coupling portion 490. The upper portion 410 and the lower portion 440 extend along the X-direction (front-rear direction, third direction). The coupling portion 490 couples an upper middle part of the upper portion 410 and a lower middle part of the lower portion 440 with each other in the Z-direction (upper-lower direction, first direction), wherein the upper middle part is located at the middle of the upper portion 410 in the X-direction, and the lower middle part is located at the middle of the lower portion 440 in the X-direction. Similarly, the second terminal 500 has an upper portion 510, a lower portion 540 and a coupling portion 590. The upper portion 510 and the lower portion 540 extend along the X-direction. The coupling portion 590 couples an upper middle part of the upper portion 510 and a lower middle part of the lower portion 540 with each other in the Z-direction, wherein the upper middle part is located at the middle of the upper portion 510 in the X-direction, and the lower middle part is located at the middle of the lower portion 540 in the X-direction. Similarly, the insulator 600 has an upper portion 610, a lower portion 640 and a coupling portion 690. The upper portion 610 and the lower portion 640 extend along the X-direction. The coupling portion 690 couples an upper middle part of the upper portion 610 and a lower middle part of the lower portion 640 with each other in the Z-direction, wherein the upper middle part is located at the middle of the upper portion 610 in the X-direction, and the lower middle part is located at the middle of the lower portion 640 in the X-direction.

The upper portion 410 of the first terminal 400 and the upper portion 510 of the second terminal 500 are fixed by the upper portion 610 of the insulator 600 to form the upper portion 310 of the terminal 300 together with the upper portion 610. The lower portion 440 of the first terminal 400 and the lower portion 540 of the second terminal 500 are fixed by the lower portion 640 of the insulator 600 to form the lower portion 340 of the terminal 300 together with the lower portion 640. The coupling portion 490 of the first terminal 400 and the coupling portion 590 of the second terminal 500 are fixed by the coupling portion 690 of the insulator 600 to form the coupling portion 390 of the terminal 300 together with the coupling portion 690.

The upper portion 410 of the first terminal 400 has a first connection portion (resiliently supporting portion) 420 and a first pushed-up portion 430. The first connection portion 420 extends forward from the coupling portion 490 while the first pushed-up portion 430 extends rearward from the coupling portion 490. The first connection portion 420 is provided with a first contact portion 412. In other words, the first terminal 400 has the first contact portion 412. The first connection portion 420 according to the present embodiment is resiliently deformable in the Z-direction (first direction) so that the first contact portion 412 is movable in the Z-direction.

The upper portion 510 of the second terminal 500 has a front arm 520 and a second pushed-up portion 530. The front arm 520 extends forward from the coupling portion 590 while the second pushed-up portion 530 extends rearward from the coupling portion 590. The front arm 520 according to the present embodiment is resiliently deformable in the Z-direction (first direction).

The first connection portion 420 of the first terminal 400 and the front arm 520 of the second terminal 500 are fixed to a front (positive X-side) part of the upper portion 610 of the insulator 600 to form the first connection portion 320 of the terminal 300. The first pushed-up portion 430 and the second pushed-up portion 530 are fixed to a rear (negative X-side) part of the upper portion 610 to form the pushed-up portion 330 of the terminal 300.

The lower portion 440 of the first terminal 400 has a front leg 450 and a first fixed portion 470. The front leg 450 extends forward from the coupling portion 490 while the first fixed portion 470 extends rearward from the coupling portion 490. The first fixed portion 470 has a rear part which is to be fixed to the conductive pad (not shown) of the printed circuit board 850 (see FIG. 1) by soldering or the like to be electrically connected with the printed circuit board 850.

The lower portion 540 of the second terminal 500 has a second connection portion (second fixed portion) 550 and a rear leg 570. The second connection portion 550 extends forward from the coupling portion 590 while the rear leg 570 extends rearward from the coupling portion 590. The second connection portion 550 has a front part which is to be fixed to the conductive pad (not shown) of the printed circuit board 850 (see FIG. 1) by soldering or the like to be electrically connected with the printed circuit board 850. The second connection portion 550 is provided with a second contact portion 542. In other words, the second terminal 500 has the second contact portion 542. When the terminal 300 is used, the second contact portion 542 according to the present embodiment is supported by the second connection portion 550, which is fixed to printed circuit board 850, to be unmovable in the Z-direction (first direction).

The front leg 450 of the first terminal 400 and the second connection portion 550 of the second terminal 500 are fixed to a front (positive X-side) part of the lower portion 640 of the insulator 600 to form the second connection portion 350 of the terminal 300. The first fixed portion 470 and the rear leg 570 are fixed to a rear (negative X-side) part of the lower portion 640 to form the first fixed portion 370 of the terminal 300.

Figure 9:
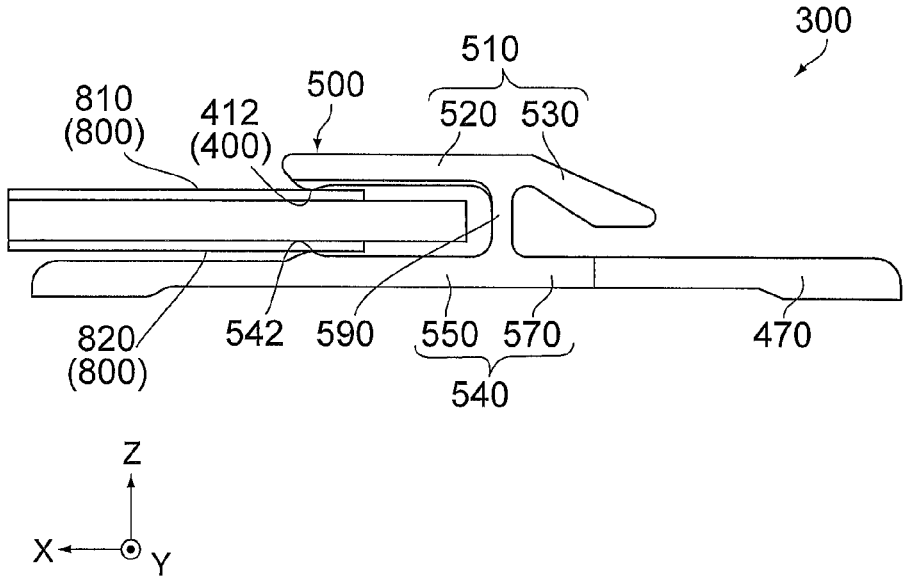
FIG. 9 is a side view from one side showing the terminal of FIG. 7 and a part of the connection object (printed circuit board) connected to the terminal.
Figure 10:
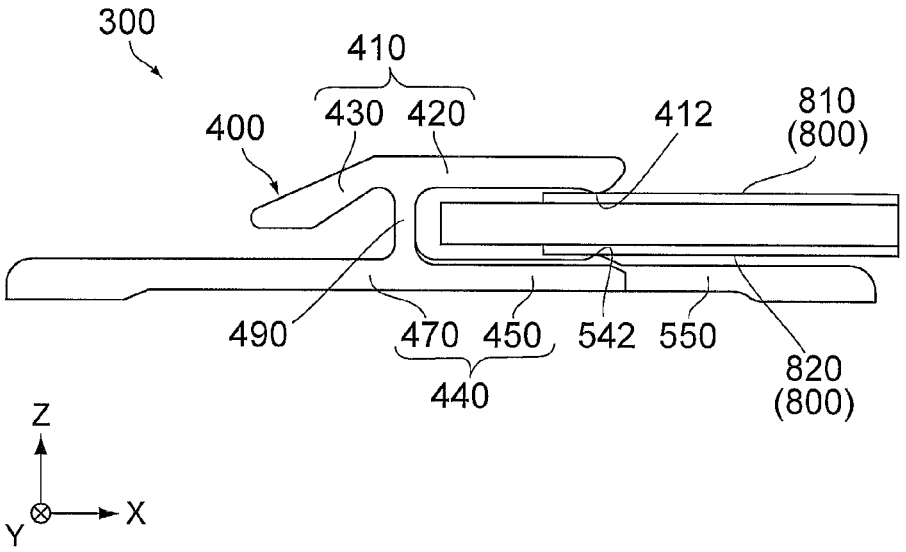
FIG. 10 is a side view from the other side showing the terminal and the printed circuit board of FIG. 9.

As shown in FIGS. 6, 9 and 10, the first contact portion 412 and the second contact portion 542 are provided to face each other in the Z-direction (first direction). When the terminal 300 is unconnected with the printed circuit board 800, a distance between the first contact portion 412 and the second contact portion 542 in the Z-direction is smaller than a size between the conductive pad 810 and the conductive pad 820 in the Z-direction. Moreover, the first contact portion 412 is supported by the first connection portion (resiliently supporting portion) 420 to be movable in the Z-direction relative to the second contact portion 542. Accordingly, when the printed circuit board 800 is inserted into the connector 10, the first contact portion 412 and the second contact portion 542 are pressed against the conductive pad 810 and the conductive pad 820 in the Z-direction, respectively. As a result, the first contact portion 412 of the first terminal 400 is electrically connected with the conductive pad 810 in the Z-direction while the second contact portion 542 of the second terminal 500 is electrically connected with the conductive pad 820 in the Z-direction.

As can be seen from FIGS. 9 and 10, the first terminal 400 has no part that is to be electrically connected with the conductive pad 820, and the second terminal 500 has no part that is to be electrically connected with the conductive pad 810. In detail, the first contact portion 412 projects inward in the Z-direction (first direction) beyond the front arm 520 of the second terminal 500, and the second contact portion 542 projects inward in the Z-direction beyond the front leg 450 of the first terminal 400. The first terminal 400 has no part that overlaps with the second contact portion 542 when seen along the Y-direction (second direction), and the second terminal 500 has no part that overlaps with the first contact portion 412 when seen along the Y-direction. Accordingly, the first terminal 400 is electrically connected with the conductive pad 810 only at the first contact portion 412, and the second terminal 500 is electrically connected with the conductive pad 820 only at the second contact portion 542. Moreover, when the first contact portion 412 and the second contact portion 542 are connected to the conductive pad 810 and the conductive pad 820, respectively, the first terminal 400 is electrically unconnected with the conductive pad 820, and the second terminal 500 is electrically unconnected with the conductive pad 810.

As shown in FIG. 8, because a width, or a size in the Y-direction (second direction), of the insulator 600 is small, the first contact portion 412 and the second contact portion 542 are little apart from each other in the Y-direction. Accordingly, the terminal 300 can include two contact portions, namely, the first contact portion 412 and the second contact portion 542, in a width which is almost same as another width of an existing single terminal. According to the present embodiment, the first contact portion 412 and the second contact portion 542 of the single terminal 300 can be close to each other in the Y-direction. Moreover, the first contact portion 412 and the second contact portion 542 are connectable to the conductive pad 810 and the conductive pad 820, respectively, wherein the conductive pad 810 and the conductive pad 820 are connected to the signal lines different from each other. The thus-formed terminals 300 are stably connectable to the conductive pads 810 and the conductive pads 820 which are arranged in high density on the upper surface 804 and the lower surface 806 of the printed circuit board 800 (see FIGS. 3 and 5). Moreover, because the first terminal 400 and the second terminal 500 are integrated into the single terminal 300, the first contact portion 412 and the second contact portion 542 can vertically sandwich the printed circuit board 800 with forces almost same as each other. Accordingly, the first contact portion 412 and the second contact portion 542 are stably brought into contact with the conductive pads 810 and the conductive pads 820, respectively.

As shown in FIGS. 7 to 10, according to the present embodiment, the first contact portion 412 and the second contact portion 542 are located at positions same as each other in the X-direction (third direction) while being located at positions slightly different from each other in the Y-direction (second direction). In order for the first contact portion 412 and the second contact portion 542 to be further stably connectable to the conductive pad 810 and the conductive pad 820, for example, the terminal 300 may be further provided with a third terminal (not shown) and a second insulator (not shown), wherein the third terminal has a shape same as that of the first terminal 400, and the second insulator has a shape same as that of the insulator 600. Moreover, the second insulator may be fixed to the positive Y-side surface of the second terminal 500, and the third terminal may be fixed to the positive Y-side surface of the second insulator.

According to the present embodiment, the first contact portion 412 and the second contact portion 542 are connected to the conductive pad 810 and the conductive pad 820, respectively, along a connection direction (first direction) that is the Z-direction perpendicular to the predetermined plane (XY-plane). However, the first direction may be oblique to the predetermined plane to some extent. In other words, it is sufficient that the first direction intersects with the predetermined plane.

Figure 11:
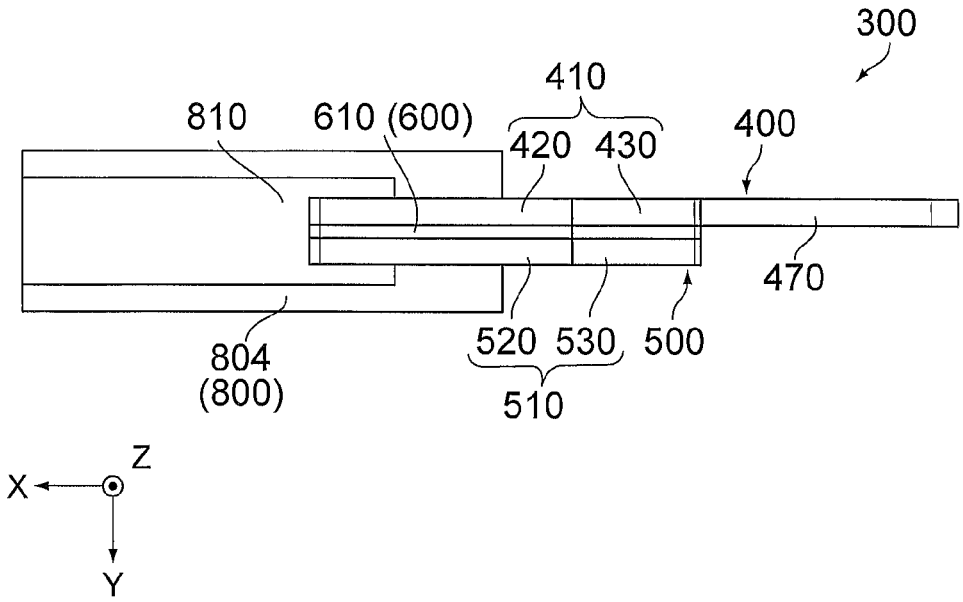
FIG. 11 is a top view showing the terminal and the printed circuit board of FIG. 9.
Figure 12:
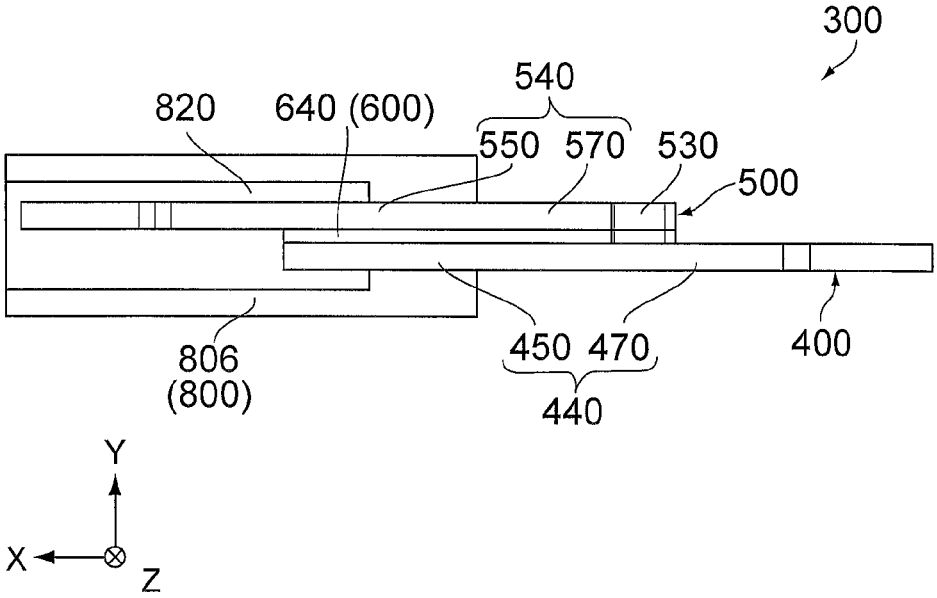
FIG. 12 is a bottom view showing the terminal and the printed circuit board of FIG. 9.

As shown in FIGS. 11 and 12, according to the present embodiment, the first fixed portion 470 and the second connection portion (second fixed portion) 550 extend to be apart from each other in the X-direction (front-rear direction, third direction) in parallel to the XY-plane (predetermined plane). Accordingly, the terminal 300 can be soldered easily. Moreover, the terminal 300 is hardly detached from the printed circuit board 850 even when receiving such a force that shakes the terminal 300.

The terminal 300 can be variously modified in addition to the already described modifications. For example, the basic structures of the first terminal 400, the second terminal 500 and the insulator 600 may be different from one another. More specifically, for example, the first terminal 400 may not have the front leg 450. Moreover, the second terminal 500 may not have the front arm 520. In other words, the first connection portion 320 of the terminal 300 may be formed only of the first connection portion 420 of the first terminal 400, and the second connection portion 350 may be formed only of the second connection portion 550 of the second terminal 500. Similarly, the first fixed portion 370 of the terminal 300 may be formed only of the first fixed portion 470 of the first terminal 400.

Moreover, the terminal according to the present invention can have various structures as described below.

(Second Embodiment)

Figure 13:
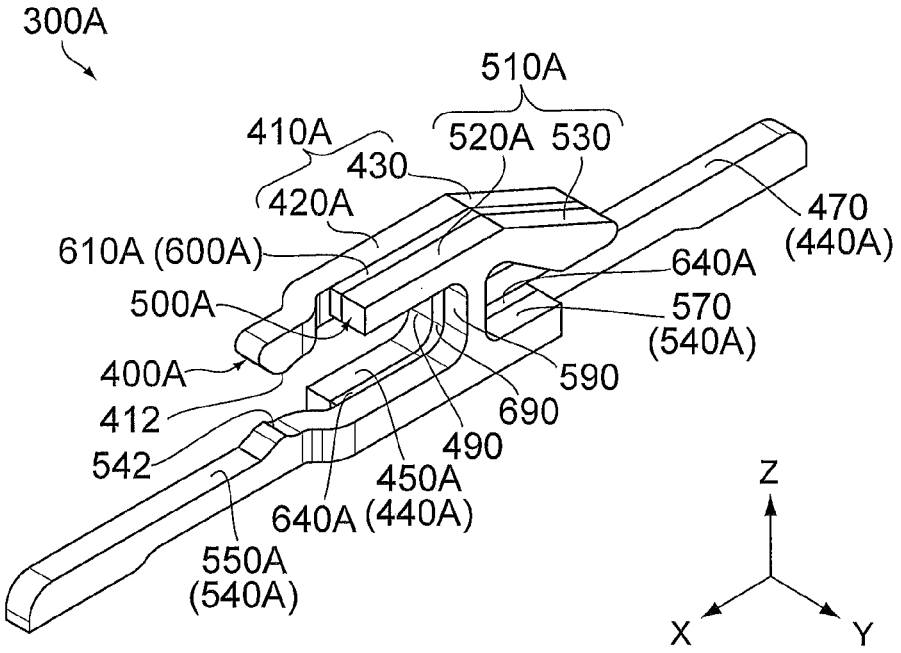
FIG. 13 is an upper perspective view showing a terminal according to a second embodiment of the present invention.
Figure 14:
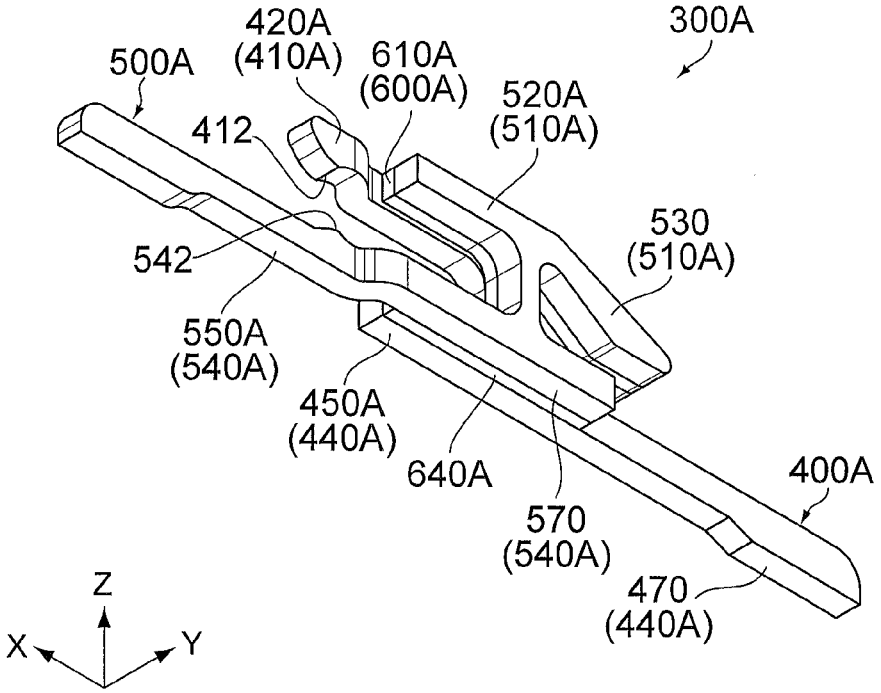
FIG. 14 is a lower perspective view showing the terminal of FIG. 13.

As shown in FIGS. 13 and 14, a terminal 300A according to a second embodiment of the present embodiment has a basic structure which is a little different from but roughly similar to that of the terminal 300 (see FIG. 7). Hereafter, explanation is made mainly about differences between the terminal 300A and the terminal 300.

Similar to the terminal 300 (see FIG. 7), the terminal 300A is formed of three components. More specifically, the terminal 300A includes a first terminal 400A made of a conductor, a second terminal 500A made of a conductor and an insulator 600A made of an insulating material such as a resin. Each of the first terminal 400A, the second terminal 500A and the insulator 600A extends on the plane perpendicular to the Y-direction (second direction). The insulator 600A is fused between the first terminal 400A and the second terminal 500A in the Y-direction to fix and integrate the first terminal 400A and the second terminal 500A.

Referring to FIGS. 7 and 13, the first terminal 400A has the coupling portion 490 same as that of the first terminal 400 while having an upper portion 410A and a lower portion 440A which are different from the upper portion 410 and the lower portion 440 of the first terminal 400, respectively. The upper portion 410A has the first pushed-up portion 430 same as that of the upper portion 410 while having a first connection portion (resiliently supporting portion) 420A which is different from the first connection portion 420 of the upper portion 410. The first connection portion 420A is provided with the first contact portion 412. The lower portion 440A has the first fixed portion 470 same as that of the lower portion 440 while having a front leg 450A which is different from the front leg 450 of the lower portion 440.

The second terminal 500A has the coupling portion 590 same as that of the second terminal 500 while having an upper portion 510A and a lower portion 540A which are different from the upper portion 510 and the lower portion 540 of the second terminal 500, respectively. The upper portion 510A has the second pushed-up portion 530 same as that of the upper portion 510 while having a front arm 520A which is different from the front arm 520 of the upper portion 510. The lower portion 540A has the rear leg 570 same as that of the lower portion 540 while having a second connection portion (second fixed portion) 550A which is different from the second connection portion 550 of the lower portion 540. The second connection portion 550A is provided with the second contact portion 542.

The insulator 600A has the coupling portion 690 same as that of the insulator 600 while having an upper portion 610A and a lower portion 640A which are different from the upper portion 610 and the lower portion 640 of the insulator 600, respectively.

Figure 16:
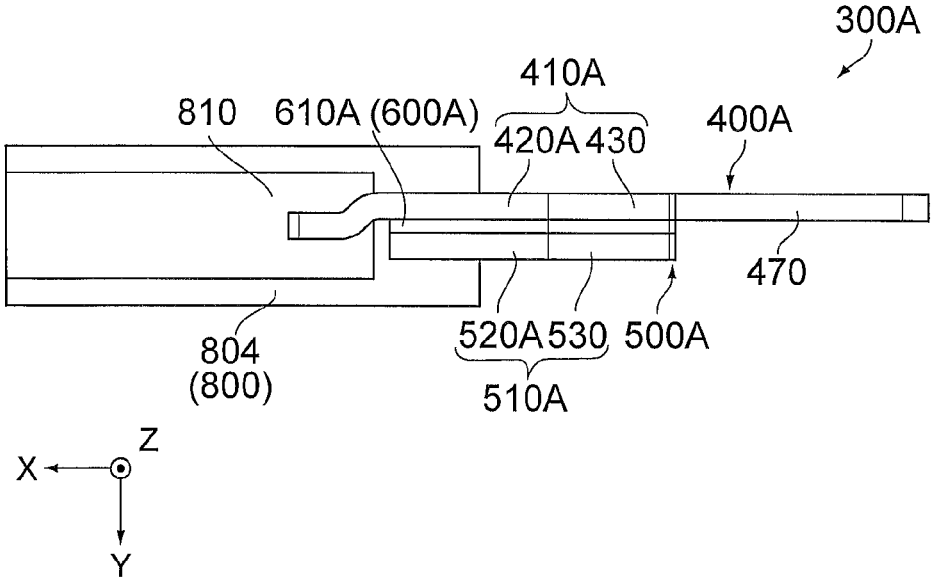
FIG. 16 is a top view showing the terminal and the printed circuit board of FIG. 15.

Referring to FIGS. 11 and 16, in the X-direction (third direction), a size of the front arm 520A is smaller than another size of the front arm 520, and a size of a front part of the upper portion 610A is smaller than another size of a front part of the upper portion 610. The first connection portion 420A is bent at a position located forward of the upper portion 610A to approach the front arm 520A. More specifically, the first connection portion 420A has a crank shape when seen along the Z-direction (first direction). Accordingly, the first contact portion 412 (see FIG. 13) is located at the middle of the terminal 300A in the Y-direction (second direction).

Figure 17:
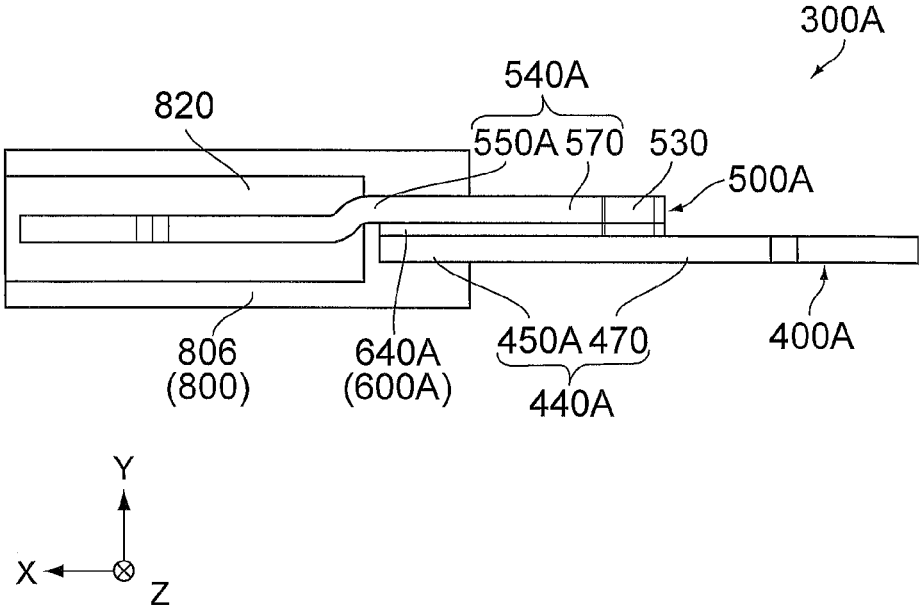
FIG. 17 is a bottom view showing the terminal and the printed circuit board of FIG. 15.

Referring to FIGS. 12 and 17, in the X-direction (third direction), a size of the front leg 450A is smaller than another size of the front leg 450, and a size of a front part of the lower portion 640A is smaller than another size of a front part of the lower portion 640. The second connection portion 550A is bent at a position located forward of the lower portion 640A to approach the front leg 450A. More specifically, the second connection portion 550A has a crank shape when seen along the Z-direction (first direction). Accordingly, the second contact portion 542 (see FIG. 13) is located at the middle of the terminal 300A in the Y-direction (second direction).

Figure 15:
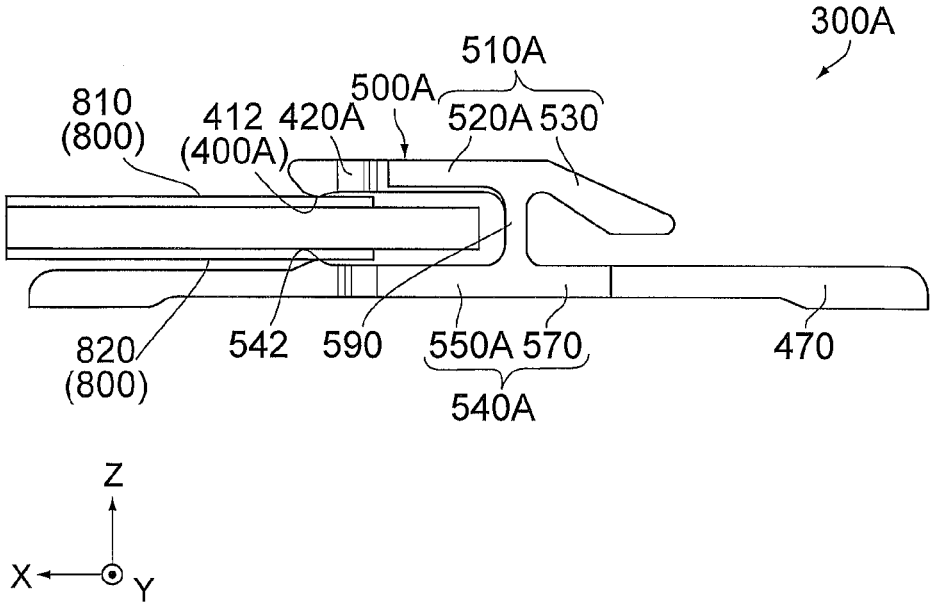
FIG. 15 is a side view showing the terminal of FIG. 13 and a part of the printed circuit board connected to the terminal.

As can be seen from FIG. 15, the terminal 300A is to be connected to the printed circuit board 800 similar to the terminal 300 (see FIG. 7). Upon the connection to the printed circuit board 800, an effect same as that of the terminal 300 can be also obtained by the terminal 300A. Moreover, the first contact portion 412 and the second contact portion 542 of the terminal 300A are located at positions same as each other in the Y-direction (second direction). Accordingly, when the terminal 300A is connected to the printed circuit board 800, a contact position of the first contact portion 412 to the conductive pad 810 in the XY-plane is same as another contact position of the second contact portion 542 to the conductive pad 820 in the XY-plane. Accordingly, the first contact portion 412 and the second contact portion 542 are further stably brought into contact with the conductive pad 810 and the conductive pad 820, respectively.

According to the present embodiment, each of the first connection portion 420A and the second connection portion 550A has the crank shape. However, only one of the first connection portion 420A and the second connection portion 550A may have the crank shape. For example, only the first connection portion 420A may have the crank shape so that the first contact portion 412 is located right above the second contact portion 542. In short, it is sufficient that at least one of the first connection portion 420A and the second connection portion 550A has the crank shape when seen along the Z-direction (first direction).

(Third Embodiment)

Figure 18:
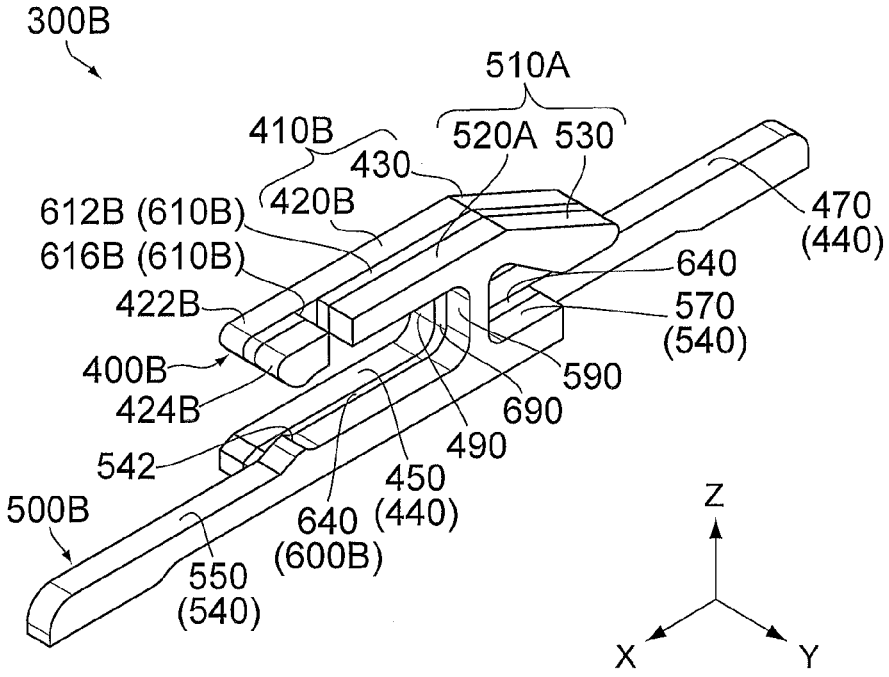
FIG. 18 is an upper perspective view showing a terminal according to a third embodiment of the present invention.

As shown in FIG. 18, a terminal 300B according to a third embodiment of the present embodiment has a basic structure which is a little different from but roughly similar to that of the terminal 300 (see FIG. 7). Hereafter, explanation is made mainly about differences between the terminal 300B and the terminal 300.

Similar to the terminal 300 (see FIG. 7), the terminal 300B is formed of three components. More specifically, the terminal 300B includes a first terminal 400B made of a conductor, a second terminal 500B made of a conductor and an insulator 600B made of an insulating material such as a resin. Each of the first terminal 400B, the second terminal 500B and the insulator 600B extends on the plane perpendicular to the Y-direction (second direction). The insulator 600B is fused between the first terminal 400B and the second terminal 500B in the Y-direction to fix and integrate the first terminal 400B and the second terminal 500B.

Figure 20:
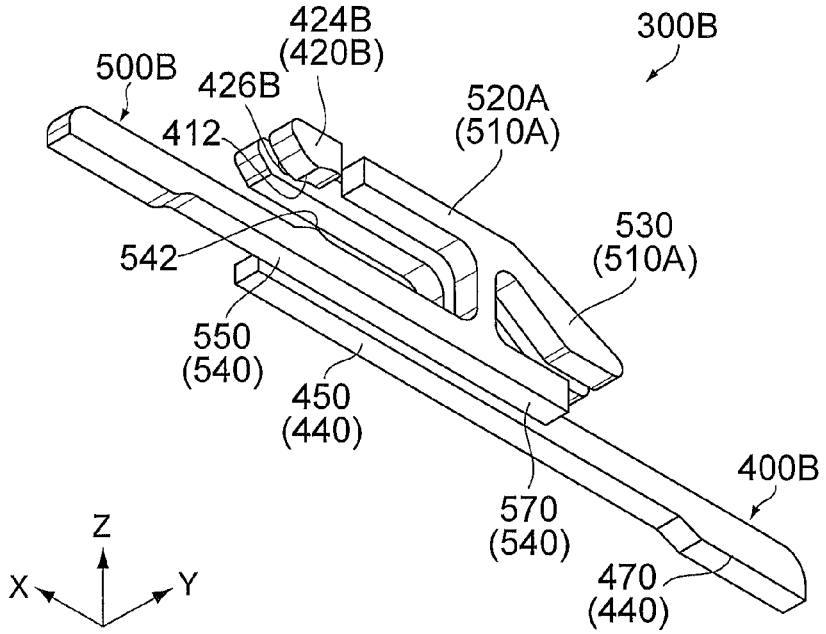
FIG. 20 is a lower perspective view showing the first terminal and the second terminal of FIG. 19.

Referring to FIGS. 7, 18 and 20, the first terminal 400B has the lower portion 440 and the coupling portion 490 same as those of the first terminal 400 while having an upper portion 410B which is different from the upper portion 410 of the first terminal 400. The upper portion 410B has the first pushed-up portion 430 same as that of the upper portion 410 while having a first connection portion (resiliently supporting portion) 420B which is different from the first connection portion 420 of the upper portion 410. The first connection portion 420B is provided with the first contact portion 412.

Referring to FIGS. 7, 13 and 18, the second terminal 500B has the upper portion 510A same as that of the second terminal 500A and has the lower portion 540 and the coupling portion 590 same as those of the second terminal 500. Accordingly, in the X-direction (third direction), the size of the front arm 520A of the second terminal 500B is smaller than the size of the front arm 520. Moreover, the second connection portion 550A is provided with the second contact portion 542.

Referring to FIGS. 7 and 18, the insulator 600B has the lower portion 640 and the coupling portion 690 same as those of the insulator 600 while having an upper portion 610B which is different from the upper portion 610 of the insulator 600. In detail, the upper portion 610B is separated into two parts, namely, a base portion 6128 and a front end portion 616B, in the vicinity of a front end in the X-direction (third direction).

Figure 19:
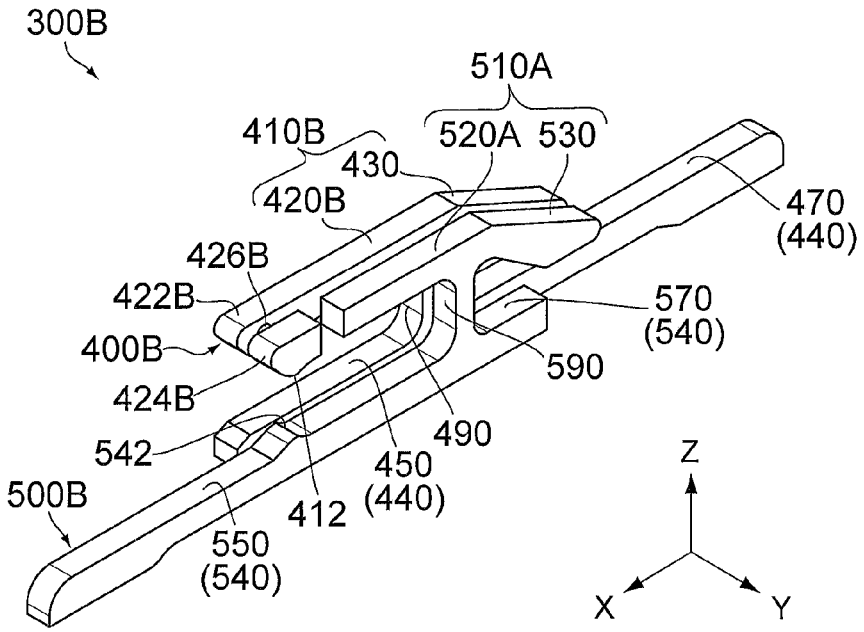
FIG. 19 is an upper perspective view showing a first terminal and a second terminal of the terminal of FIG. 18.
Figure 22:
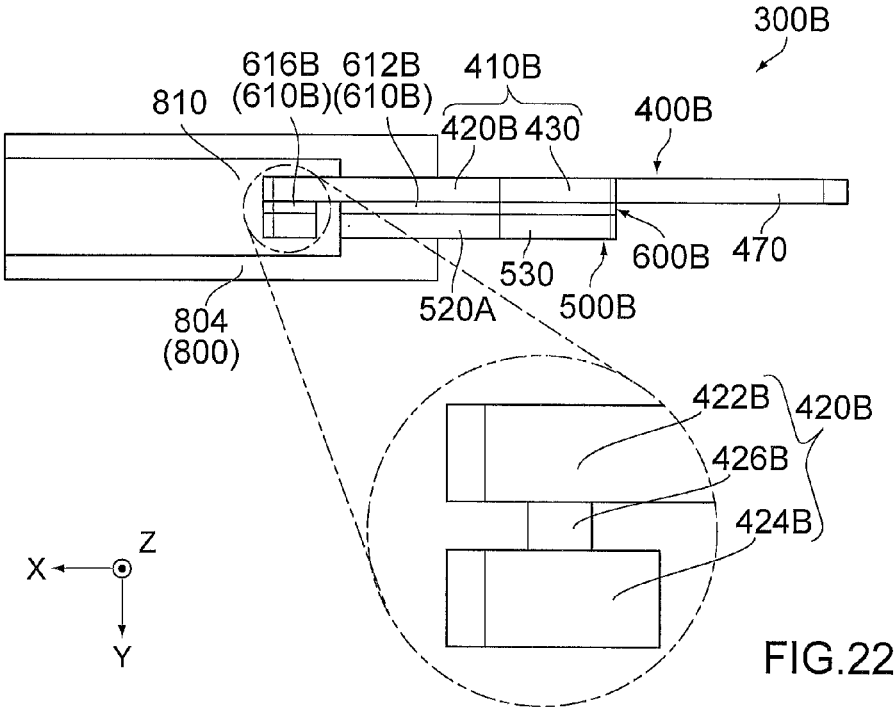
FIG. 22 is a top view showing the terminal and the printed circuit board of FIG. 21, wherein the vicinity of an end of a first connection portion (a part encircled by chain dotted line) is enlarged to be illustrated except an insulator.

As shown in FIGS. 19, 20 and 22, the first connection portion 420B (the first terminal 400B) has a base portion 422B, a protruding portion 424B and a link portion (via) 426B. The base portion 422B extends along the X-direction (third direction). The protruding portion 424B is apart from the base portion 422B in the Y-direction (second direction) to be located forward of the front arm 520A of the second terminal 500B. The link portion 426B links the base portion 422B and the protruding portion 424B in the Y-direction. The link portion 426B is covered by the front end portion 616B of the insulator 600B. The first contact portion 412 is provided at the protruding portion 424B. Accordingly, the first contact portion 412 is located at a position same as that of the second contact portion 542 in the Y-direction.

Figure 21:
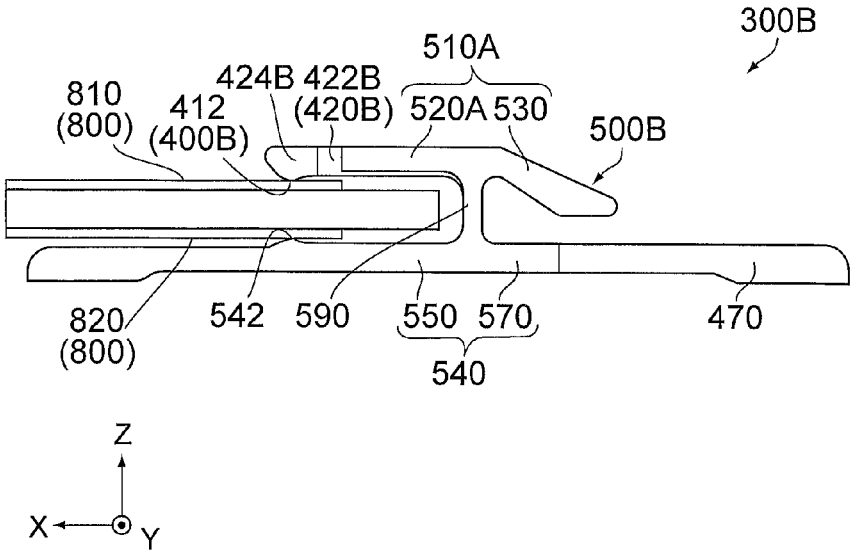
FIG. 21 is a side view showing the terminal of FIG. 18 and a part of the printed circuit board connected to the terminal.

As can be seen from FIG. 21, the terminal 300B is to be connected to the printed circuit board 800 similar to the terminal 300A (see FIG. 13). Upon the connection to the printed circuit board 800, an effect same as that of the terminal 300A can be also obtained by the terminal 300B.

The link portion 426B according to the present embodiment has a cylindrical shape. However, the link portion 426B may have any shape, provided that the base portion 422B and the protruding portion 424B are electrically securely connected with each other.

(Fourth Embodiment)

Figure 23:
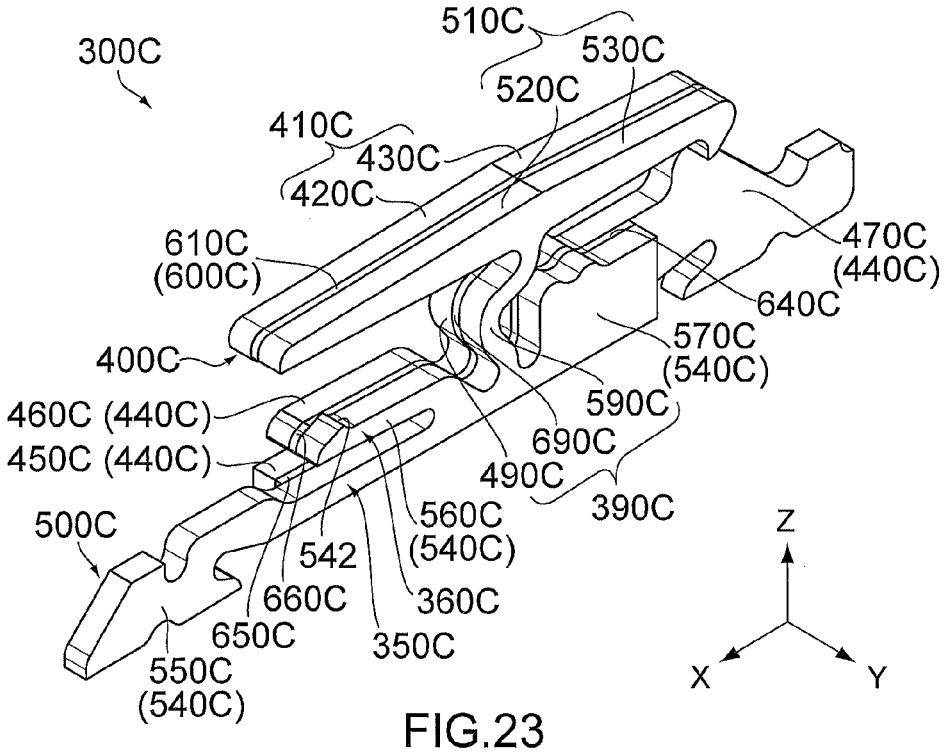
FIG. 23 is an upper perspective view showing a terminal according to a fourth embodiment of the present invention.
Figure 24:
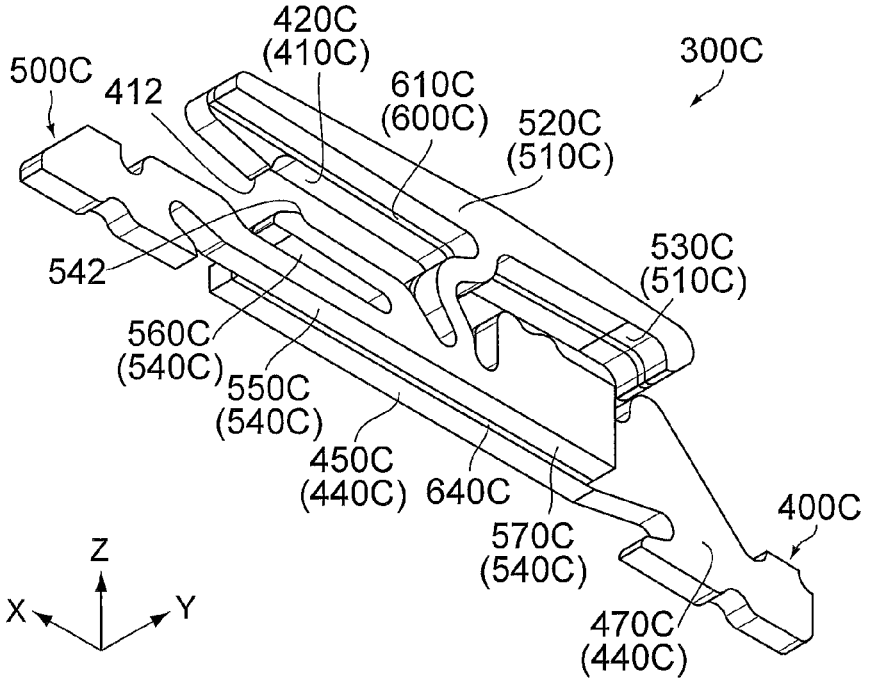
FIG. 24 is a lower perspective view showing the terminal of FIG. 23.

As shown in FIGS. 23 and 24, a terminal 300C according to a fourth embodiment of the present embodiment has a second fixed portion 350C and a second connection portion 360C instead of the second connection portion 350 of the terminal 300 (see FIG. 7). Moreover, each portion of the terminal 300C has a complex shape in comparison with a corresponding portion of the terminal 300. In particular, the terminal 300C has a coupling portion 390C which has a shape different from that of the coupling portion 390. The terminal 300C has a basic structure roughly similar to that of the terminal 300 except the differences described above. Hereafter, explanation is made mainly about differences between the terminal 3000 and the terminal 300.

The second fixed portion 350C is a portion to be fixed to the printed circuit board 850 (see FIG. 1). The second connection portion 360C extends forward over the second fixed portion 350C. The second connection portion 360C is supported by the second fixed portion 350C to be resiliently deformable in the Z-direction (first direction). The coupling portion 390C has a meander shape in the XZ-plane to be resiliently deformable easily in the XZ-plane.

Similar to the terminal 300 (see FIG. 7), the terminal 300C is formed of three components. More specifically, the terminal 300C includes a first terminal 400C made of a conductor, a second terminal 500C made of a conductor and an insulator 600C made of an insulating material such as a resin. Each of the first terminal 400C, the second terminal 500C and the insulator 600C extends on the plane perpendicular to the Y-direction (second direction). The insulator 600C is fused between the first terminal 400C and the second terminal 500C in the Y-direction to fix and integrate the first terminal 400C and the second terminal 500C.

The first terminal 400C has an upper portion 410C, a lower portion 440C and a coupling portion 490C. The upper portion 410C has a first connection portion (resiliently supporting portion) 420C and a first pushed-up portion 430C. The lower portion 440C has a front leg 450C, an auxiliary portion 460C and a first fixed portion 470C. The first connection portion 420C, the first pushed-up portion 430C, the first fixed portion 470C and the coupling portion 490C has basic structures and functions roughly similar to those of the first connection portion 420, the first pushed-up portion 430, the first fixed portion 470 and the coupling portion 490 of the first terminal 400 (see FIG. 7).

The second terminal 500C has an upper portion 510C, a lower portion 540C and a coupling portion 590C. The upper portion 510C has a front arm 5200 and a second pushed-up portion 530C. The lower portion 540C has a second fixed portion 550C, a second connection portion (resiliently supporting portion) 560C and a rear leg 570C. The front arm 520C, the second pushed-up portion 530C, the rear leg 570C and the coupling portion 590C has basic structures and functions roughly similar to those of the front arm 520, the second pushed-up portion 530, the rear leg 570 and the coupling portion 590 of the second terminal 500 (see FIG. 7).

The insulator 600C has an upper portion 6100, a lower portion 6400 and a coupling portion 690C. The upper portion 610C and the coupling portion 690C has basic structures and functions roughly similar to those of the upper portion 610 and the coupling portion 690 of the insulator 600 (see FIG. 7). On the other hand, the lower portion 640C has a front part different from that of the lower portion 640. In detail, the front part of the lower portion 640C is vertically separated into two parts, namely, a front leg 650C and a front arm 660C, to extend forward.

The front leg 450C of the first terminal 400C and the second fixed portion 550C of the second terminal 5000 are fixed to the front leg 650C of the insulator 600C to form the second fixed portion 350C of the terminal 300C. The auxiliary portion 460C and the second connection portion 560C are fixed to the front arm 660C to form the second connection portion 360C of the terminal 300C.

Each of the first connection portion 420C and the second connection portion 560C is resiliently deformable in the Z-direction (first direction). In other words, the first terminal 400C and the second terminal 500C according to the present embodiment has the resiliently supporting portion 420C that is resiliently deformable and the resiliently supporting portion 560C that is resiliently deformable, respectively. The first contact portion 412 is provided at the first connection portion 420C while the second contact portion 542 is provided at the second connection portion 560C. In other words, the first contact portion 412 and the second contact portion 542 are supported by the resiliently supporting portion 420C and the resiliently supporting portion 560C, respectively. Accordingly, the first contact portion 412 is movable in the Z-direction relative to the second contact portion 542, and the second contact portion 542 is movable in the Z-direction relative to the first contact portion 412.

Figure 25:
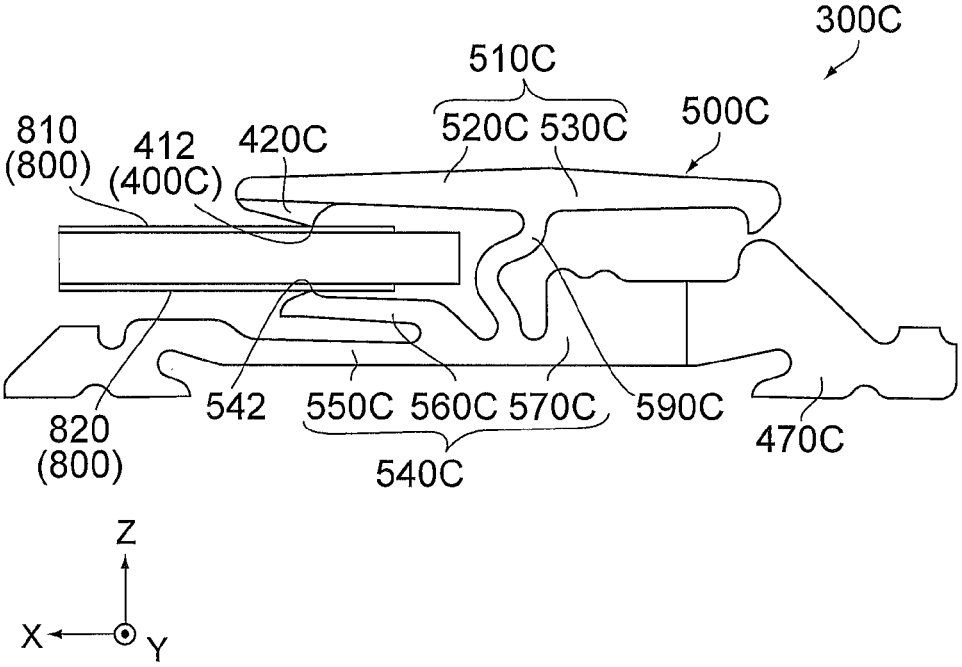
FIG. 25 is a side view showing the terminal of FIG. 23 and a part of the printed circuit board connected to the terminal.

As can be seen from FIG. 25, the terminal 300C is to be connected to the printed circuit board 800 similar to the terminal 300 (see FIG. 7). Upon the connection to the printed circuit board 800, an effect same as that of the terminal 300 can be also obtained by the terminal 3000. Moreover, according to the present embodiment, the coupling portion 390C is resiliently deformed more easily, and each of the first contact portion 412 and the second contact portion 542 is supported to be movable in the Z-direction (first direction). Accordingly, the terminal 300C can be more stably connected to the printed circuit board 800, for example, even if the printed circuit board 800 has variance of thickness, or variance of size in the Z-direction (first direction), in the Y-direction (second direction).

However, according to the present invention, only one of the first contact portion and the second contact portion may be supported to be movable in the Z-direction (first direction). In other words, at least one of the first terminal and the second terminal may have the resiliently supporting portion which is resiliently deformable. Moreover, at least one of the first contact portion and the second contact portion may be supported by the resiliently supporting portion to be movable in the Z-direction relative to a remaining one of the first contact portion and the second contact portion. Moreover, as described below, each of the first contact portion and the second contact portion may be supported to be unmovable in the Z-direction.

(Fifth Embodiment)

Figure 26:
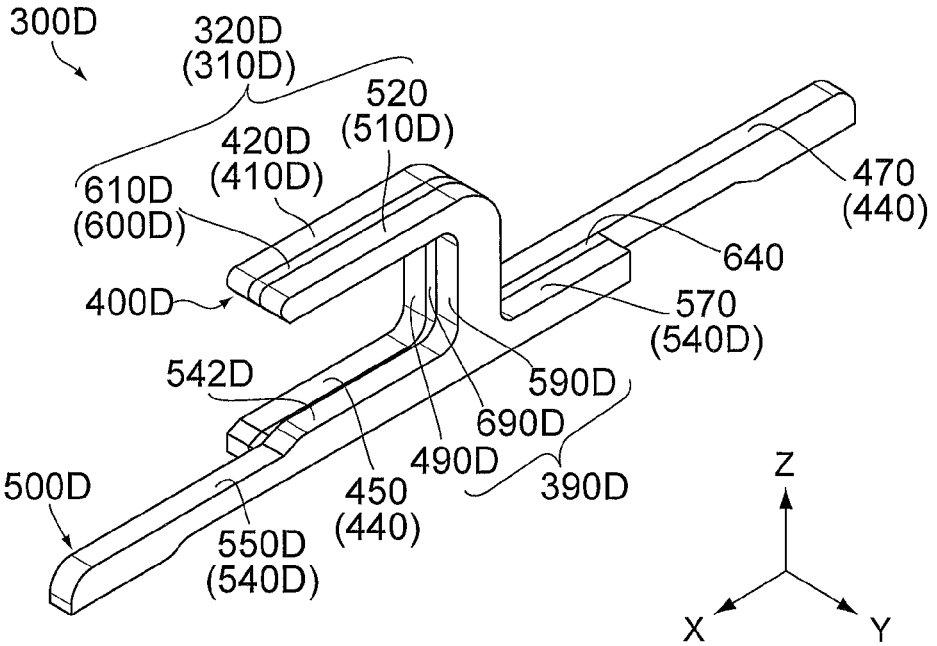
FIG. 26 is an upper perspective view showing a terminal according to a fifth embodiment of the present invention.
Figure 27:
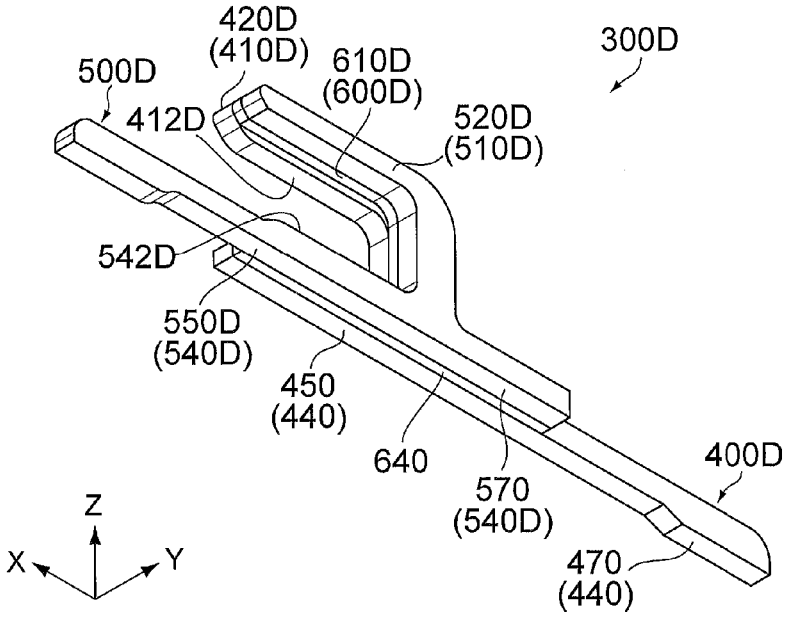
FIG. 27 is a lower perspective view showing the terminal of FIG. 26.

As shown in FIGS. 26 and 27, a terminal 300D according to a fifth embodiment of the present embodiment has no part that corresponds to the pushed-up portion 330 of the terminal 300 (see FIG. 7). In detail, the terminal 300D has an upper portion 310D which is formed only of a first connection portion 320D. Moreover, the terminal 300D has a coupling portion 390D which is a little different from the coupling portion 390. The coupling portion 390D has a relatively large size in the X-direction (third direction). Because the terminal 300D is formed as described above, the first connection portion 320D is relatively hardly deformed in the XZ-plane. The terminal 300D has a basic structure roughly similar to that of the terminal 300 except the differences described above. Hereafter, explanation is made mainly about differences between the terminal 300D and the terminal 300.

Similar to the terminal 300 (see FIG. 7), the terminal 300D is formed of three components. More specifically, the terminal 300D includes a first terminal 400D made of a conductor, a second terminal 500D made of a conductor and an insulator 600D made of an insulating material such as a resin. Each of the first terminal 400D, the second terminal 500D and the insulator 600D extends on the plane perpendicular to the Y-direction (second direction). The insulator 600D is fused between the first terminal 4000 and the second terminal 500D in the Y-direction to fix and integrate the first terminal 400D and the second terminal 500D.

Referring to FIGS. 7, 8, 26 and 27, the first terminal 400D has the lower portion 440 same as that of the first terminal 400 while having an upper portion 410D and a coupling portion 490D which are different from the upper portion 410 and the coupling portion 490 of the first terminal 400, respectively. The upper portion 410D has a first connection portion 420D which is different from the first connection portion 420 of the upper portion 410 and has no part that corresponds to the first pushed-up portion 430. The coupling portion 490D has a relatively large size in the X-direction (third direction). Accordingly, the first connection portion 420D is hardly resiliently deformed in comparison with the first connection portion 420. The first connection portion 420D is provided with a first contact portion 412D. The first contact portion 412D is supported by the first connection portion 420D, which is formed as described above, to be unmovable in the Z-direction (first direction).

The second terminal 500D has an upper portion 510D, a lower portion 540D and a coupling portion 590D which are different from the upper portion 510, the lower portion 540 and the coupling portion 590 of the second terminal 500, respectively. The upper portion 510D has the front arm 520 same as that of the upper portion 510 while having no part that corresponds to the second pushed-up portion 530. The coupling portion 590D has a relatively large size in the X-direction (third direction). The lower portion 540D has the rear leg 570 same as that of the lower portion 540 while having a second connection portion (second fixed portion) 550D which is different from the second connection portion 550 of the lower portion 540. The second connection portion 550D is provided with a second contact portion 542D. When the terminal 300D is used, the second contact portion 542D is supported by the second connection portion 550D, which is fixed to the printed circuit board 850 (see FIG. 1), to be unmovable in the Z-direction (first direction). According to the present embodiment, each of the first contact portion 412D and the second contact portion 542D is supported to be unmovable in the Z-direction when the terminal 300D is used.

The insulator 600D has the lower portion 640 same as that of the insulator 600 while having an upper portion 610D and a coupling portion 690D which are different from the upper portion 610 and the coupling portion 690 of the insulator 600, respectively. In detail, the upper portion 610D has no part that is located rearward of the coupling portion 690D. Moreover, the coupling portion 690D has a relatively large size in the X-direction (third direction).

Figure 28:
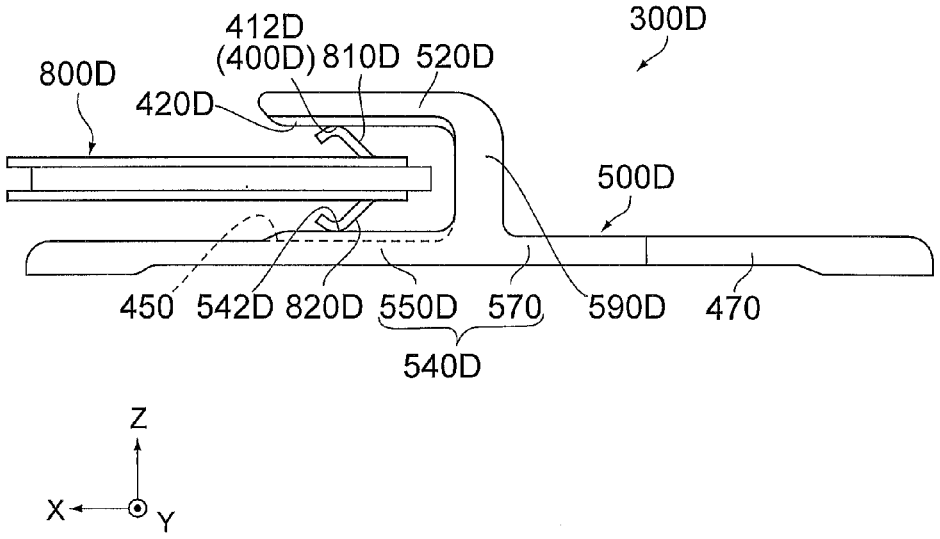
FIG. 28 is a side view showing the terminal of FIG. 26 and a part of a connection object (mating connector) connected to the terminal, wherein an upper edge of a hidden front leg of a first terminal is illustrated by dashed line.
Figure 29:
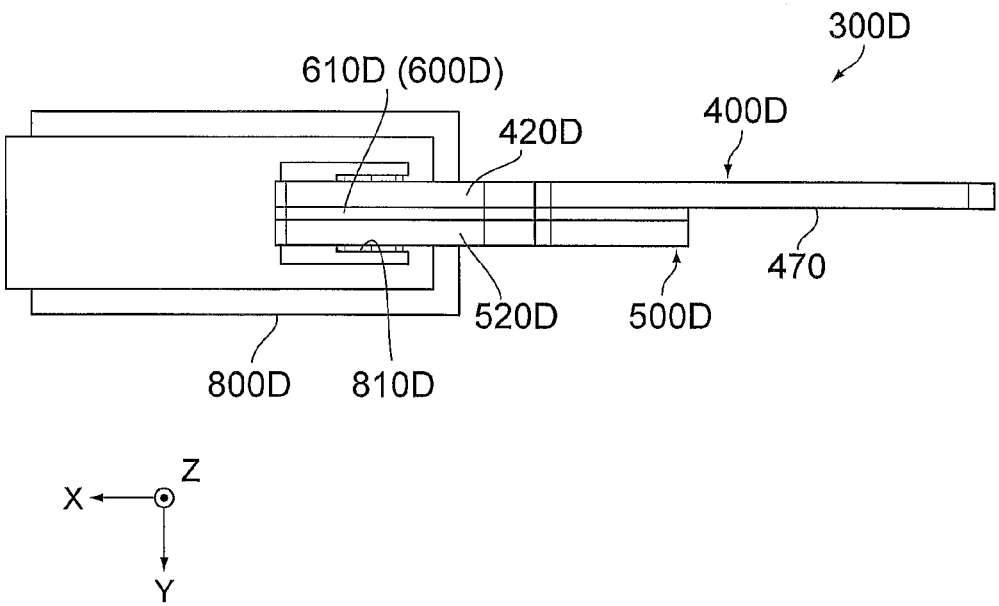
FIG. 29 is a top view showing the terminal and the mating connector of FIG. 28.

As shown in FIG. 28, the first contact portion 412D projects inward in the Z-direction (first direction) beyond the front arm 520D of the second terminal 500D, and the second contact portion 542D projects inward in the Z-direction beyond the front leg 450 of the first terminal 400D. The first contact portion 412D and the second contact portion 542D extend long along the X-direction (third direction). Moreover, the first contact portion 412D and the second contact portion 542D are located at positions same as each other in the X-direction. The thus-formed terminal 300D is connectable to a connection object (mating connector) 800D. In other words, the connection object of the terminal 300D is the mating connector 800D.

The mating connector 800D comprises a plurality of first mating connection portions (first mating terminals) 810D each made of a conductor, a plurality of second mating connection portions (second mating terminals) 820D each made of a conductor and a housing which holds the first mating terminals 810D and the second mating terminals 820D, wherein only one of the first mating terminals 810D, only one of the second mating terminals 820D and only a part of the housing are illustrated in FIG. 28. The first mating terminals 810D and the second mating terminals 820D are oppositely located on the mating connector 800D in the Z-direction (first direction). In detail, the first mating terminals 810D are provided on an upper side (positive Z-side) of the mating connector 800D while the second mating terminals 820D are provided on a lower side (negative Z-side) of the mating connector 800D. Each of the first mating terminals 810D and the second mating terminals 820D is resiliently deformable in the Z-direction.

The first terminal 400D has no part that overlaps with the second contact portion 542D when seen along the Y-direction (second direction), and the second terminal 500D has no part that overlaps with the first contact portion 412D when seen along the Y-direction. Accordingly, the first terminal 400D is to be electrically connected with the first mating terminal 810D, which is resiliently deformed, only at the first contact portion 412D, and the second terminal 500D is to be electrically connected with the second mating terminal 820D, which is resiliently deformed, only at the second contact portion 542D.

As can be seen from the above explanation, the first terminal 400D has no part that is to be electrically connected with the second mating terminal 820D, and the second terminal 500D has no part that is to be electrically connected with the first mating terminal 810D. Accordingly, when the first contact portion 412D and the second contact portion 542D are connected to the first mating terminal 810D and the second mating terminal 820D, respectively, the first terminal 400D is electrically unconnected with the second mating terminal 820D, and the second terminal 500D is electrically unconnected with the first mating terminal 810D. In short, an effect same as that of the terminal 300 (see FIG. 7) can be also obtained by the terminal 300D.

(Sixth Embodiment)

Figure 30:
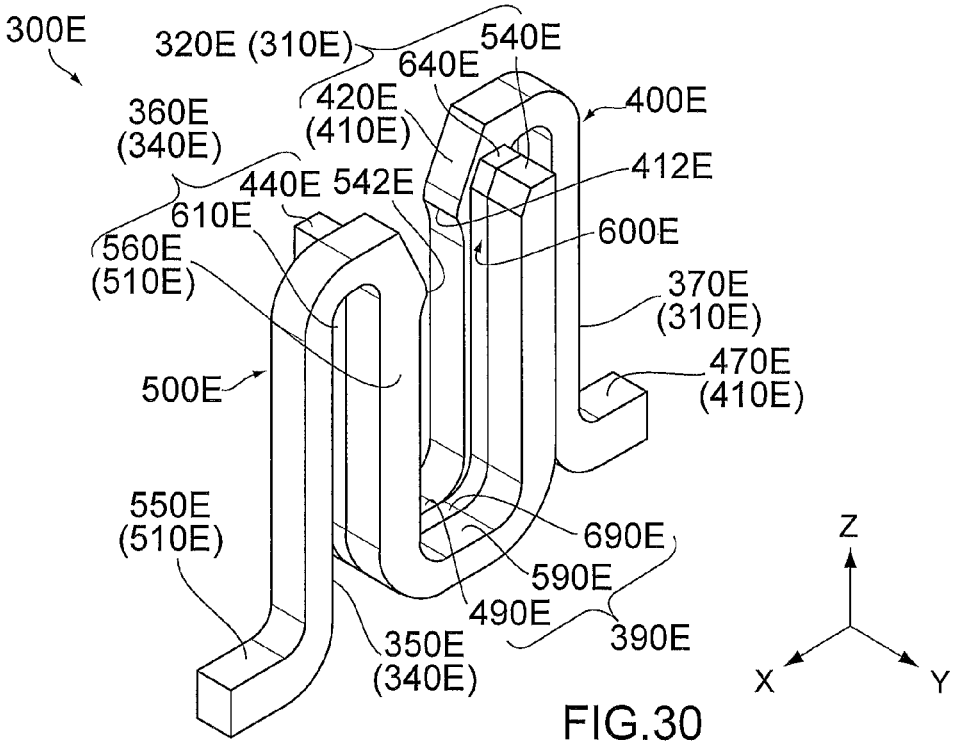
FIG. 30 is an upper perspective view showing a terminal according to a sixth embodiment of the present invention.
Figure 31:
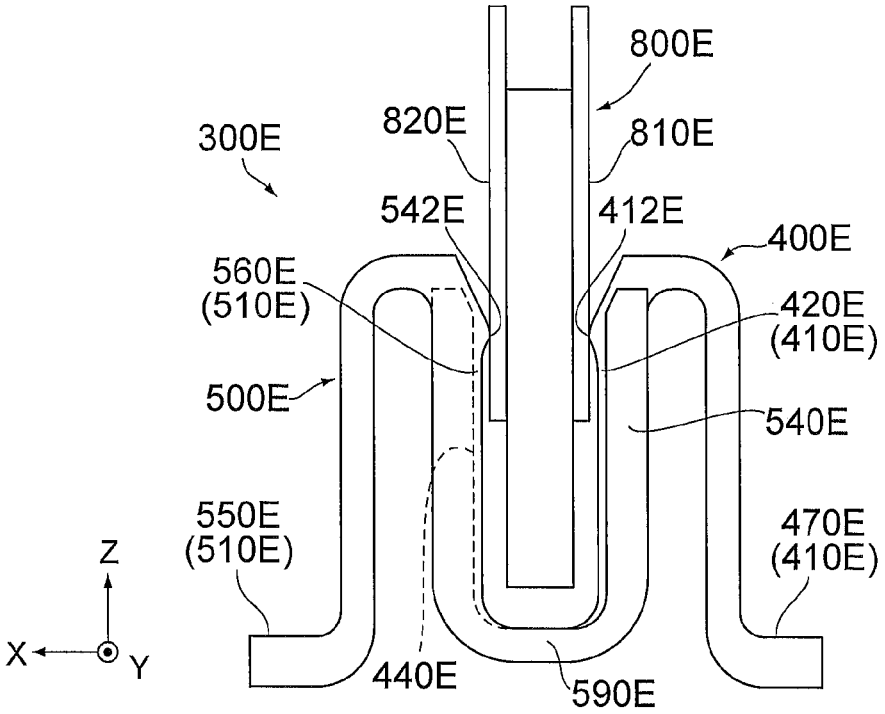
FIG. 31 is a front view showing the terminal of FIG. 30 and a part of a mating connector connected to the terminal, wherein an outline of a hidden secondary portion of a first terminal is illustrated by dashed line.
Figure 32:
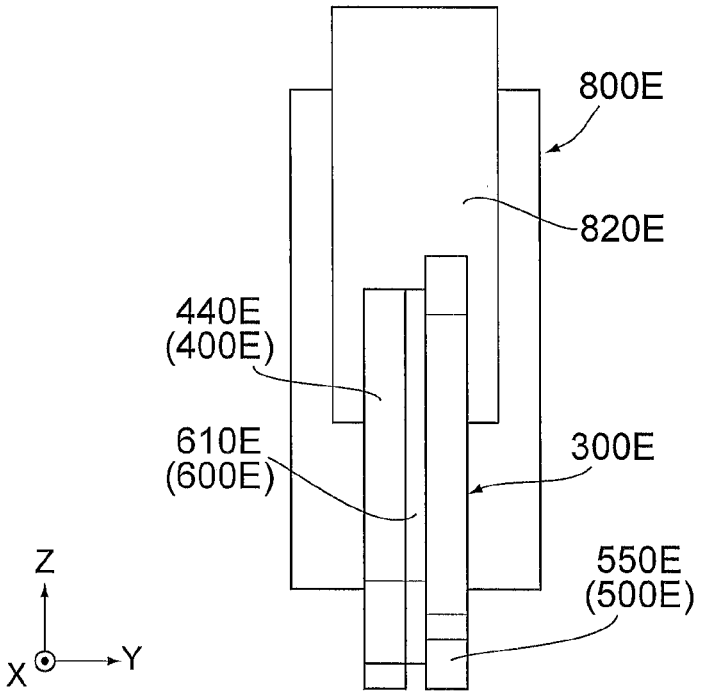
FIG. 32 is a side view showing the terminal and the mating connector of FIG. 31.

As can be seen from FIGS. 30 to 32, a terminal 300E according to a sixth embodiment of the present embodiment is accommodated in an on-board connector (not shown) different from the connector 10 (see FIG. 1). This on-board connector is to be fixed to the printed circuit board 850 (see FIG. 1) which extends along the XY-plane (predetermined plane). The terminal 300E is to be connected to a connection object (mating connector) 800E which is inserted into this on-board connector from above. In other words, the fixing object of the terminal 300E is the printed circuit board 850, and the connection object of the terminal 300E is the mating connector 800E.

As can be seen from FIGS. 31 and 32, the mating connector 800E comprises a plurality of first mating connection portions (first mating terminals) 810E, a plurality of second mating connection portions (second mating terminals) 820E and a housing which holds the first mating terminals 810E and the second mating terminals 820E, wherein only one of the first mating terminals 810E, only one of the second mating terminals 820E and only a part of the housing are illustrated in FIGS. 31 and 32. The first mating terminals 810E and the second mating terminals 820E are oppositely located on the mating connector 800E in the X-direction (front-rear direction, first direction). In detail, the first mating terminals 810E are provided on a rear side (negative X-side) of the mating connector 800E while the second mating terminals 820E are provided on a front side (positive X-side) of the mating connector 800E.

As shown in FIG. 30, the terminal 300E has a rear portion 310E, a front portion 340E and a coupling portion 390E. The front portion 340E has a shape that can be obtained by rotating the rear portion 310E by 180° around an axis which is in parallel to the Z-direction (upper-lower direction, third direction). In detail, the rear portion 310E has a first connection portion 320E and a first fixed portion 370E while the front portion 340E has a second connection portion 360E and a second fixed portion 350E. The first connection portion 320E and the second connection portion 360E extend along the Z-direction. The coupling portion 390E couples a lower end (negative Z-side end) of the first connection portion 320E and a lower end of the second connection portion 360E with each other in the X-direction (first direction). The first fixed portion 370E extends downward (in the negative Z-direction) from an upper end (positive Z-side end) of the first connection portion 320E. Moreover, the first fixed portion 370E has a lower end which extends rearward (in the negative X-direction). The second fixed portion 350E extends downward from an upper end of the second connection portion 360E. Moreover, the second fixed portion 350E has a lower end which extends forward (in the positive X-direction). The lower end of the first fixed portion 370E and the lower end of the second fixed portion 350E are to be fixed to the printed circuit board 850 (see FIG. 1). Each of the first connection portion 320E and the second connection portion 360E of the thus-formed terminal 300E is resiliently deformable in the X-direction.

Similar to the terminal 300 (see FIG. 7), the terminal 300E is formed of three components. More specifically, the terminal 300E includes a first terminal 400E made of a conductor, a second terminal 500E made of a conductor and an insulator 600E made of an insulating material such as a resin. Each of the first terminal 400E, the second terminal 500E and the insulator 600E extends on a plane perpendicular to the Y-direction (pitch direction, second direction). The insulator 600E is fused between the first terminal 400E and the second terminal 500E in the Y-direction to fix and integrate the first terminal 400E and the second terminal 500E while insulating the first terminal 400E and the second terminal 500E from each other.

The first terminal 400E has a primary portion 410E, a secondary portion 440E and a coupling portion 490E. The primary portion 410E has a first connection portion (resiliently supporting portion) 420E and a first fixed portion 470E. The first connection portion 420E and the secondary portion 440E extend along the Z-direction (third direction). The first connection portion 420E is provided with a first contact portion 412E. The coupling portion 490E couples a lower end of the first connection portion 420E and a lower end of the secondary portion 440E with each other in the X-direction (first direction). The first fixed portion 470E extends downward from an upper end of the first connection portion 420E. Moreover, the first fixed portion 470E has a lower end which extends rearward.

The second terminal 500E has a shape that can be obtained by rotating the first terminal 400E by 180° around an axis which is in parallel to the Z-direction (third direction). In detail, the second terminal 500E has a primary portion 510E, a secondary portion 540E and a coupling portion 590E. The primary portion 510E has a second connection portion (resiliently supporting portion) 560E and a second fixed portion 550E. The second connection portion 560E and the secondary portion 540E extend along the Z-direction. The second connection portion 560E is provided with a second contact portion 542E. The coupling portion 590E couples a lower end of the second connection portion 560E and a lower end of the secondary portion 540E with each other in the X-direction (first direction). The second fixed portion 550E extends downward from an upper end of the second connection portion 560E. Moreover, the second fixed portion 550E has a lower end which extends forward.

The insulator 600E has a shape which is 2-fold rotationally symmetric about an axis which is in parallel to the Z-direction (third direction). In detail, the insulator 600E has a front portion 610E, a rear portion 640E and a coupling portion 690E. The front portion 610E and the rear portion 640E extend along the Z-direction. The coupling portion 690E couples a lower end of the front portion 610E and a lower end of the rear portion 640E with each other in the X-direction (first direction).

The first connection portion 420E of the first terminal 400E and the secondary portion 540E of the second terminal 500E are fixed to the rear portion 640E of the insulator 600E to form the first connection portion 320E of the terminal 300E. The secondary portion 440E and the second connection portion 560E are fixed to the front portion 610E to form the second connection portion 360E of the terminal 300E. The coupling portion 490E and the coupling portion 590E are fixed to the coupling portion 690E to form the coupling portion 390E of the terminal 300E. The first fixed portion 370E of the terminal 300E is formed only of the first fixed portion 470E of the first terminal 400E, and the second fixed portion 350E of the terminal 300E is formed only of the second fixed portion 550E of the second terminal 500E.

As shown in FIG. 31, the first contact portion 412E is to be electrically connected with the first mating terminal 810E in the X-direction (first direction) while the second contact portion 542E is to be electrically connected with the second mating terminal 820E in the X-direction. Accordingly, the connection direction (first direction) according to the present embodiment is the front-rear direction which is in parallel to the XY-plane.

In detail, each of the first connection portion 420E and the second connection portion 560E is resiliently deformable in the X-direction (first direction). The first contact portion 412E and the second contact portion 542E are supported by the first connection portion 420E and the second connection portion 560E, respectively, to be movable in the X-direction relative to each other.

The first contact portion 412E projects inward in the X-direction (first direction) beyond the secondary portion 540E of the second terminal 500E, and the second contact portion 542E projects inward in the X-direction beyond the secondary portion 440E of the first terminal 400E. The first contact portion 412E and the second contact portion 542E are located at positions same as each other in the Z-direction (third direction).

The first terminal 400E has no part that overlaps with the second contact portion 542E when seen along the Y-direction (second direction), and the second terminal 500E has no part that overlaps with the first contact portion 412E when seen along the Y-direction. The first terminal 400E is to be electrically connected with the first mating terminal 810E only at the first contact portion 412E, and the second terminal 500E is to be electrically connected with the second mating terminal 820E only at the second contact portion 542E.

The first terminal 400E has no part that is to be electrically connected with the second mating terminal 820E, and the second terminal 500E has no part that is to be electrically connected with the first mating terminal 810E. Accordingly, when the first contact portion 412E and the second contact portion 542E are connected to the first mating terminal 810E and the second mating terminal 820E, respectively, the first terminal 400E is electrically unconnected with the second mating terminal 820E, and the second terminal 500E is electrically unconnected with the first mating terminal 810E.

Moreover, the lower end of the first fixed portion 470E and the lower end of the second fixed portion 550E extend to be apart from each other in the X-direction (front-rear direction). Accordingly, the terminal 300E can be soldered easily. Moreover, the terminal 300E is hardly detached from the printed circuit board 850 (see FIG. 1) even when receiving such a force that shakes the terminal 300E.

As can be seen from the above explanation, an effect same as that of the terminal 300 (see FIG. 7) can be also obtained by the terminal 300E.

(Seventh Embodiment)

Figure 33:
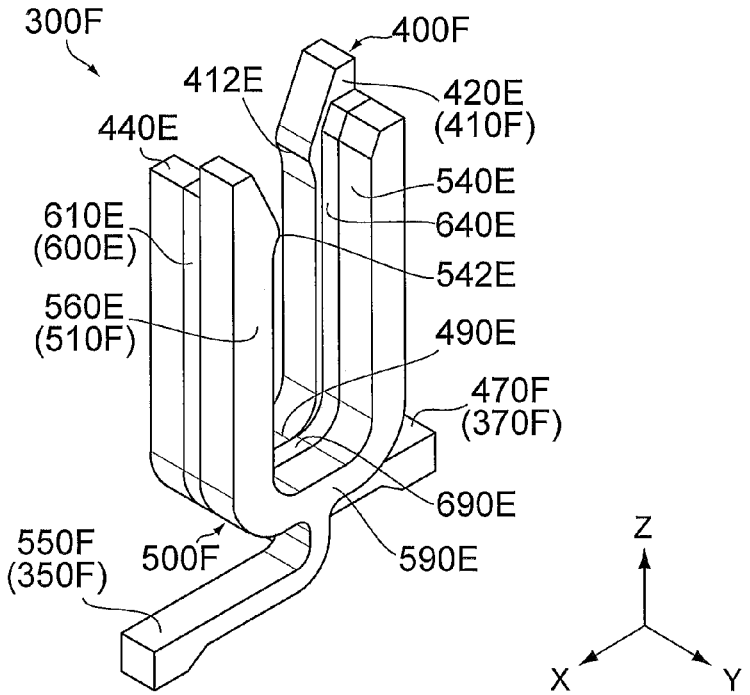
FIG. 33 is an upper perspective view showing a terminal according to a seventh embodiment of the present invention.

As shown in FIG. 33, a terminal 300F according to a seventh embodiment of the present embodiment has a first fixed portion 370F and a second fixed portion 350F instead of the first fixed portion 370E and the second fixed portion 350E of the terminal 300E (see FIG. 30). Each of the first fixed portion 370F and the second fixed portion 350F is a portion which is to be fixed to the printed circuit board 850 (see FIG. 1). The terminal 300F has a basic structure roughly similar to that of the terminal 300E except the differences described above. Hereafter, explanation is made mainly about differences between the terminal 300F and the terminal 300E.

Similar to the terminal 300E (see FIG. 30), the terminal 300F is formed of three components. More specifically, the terminal 300F includes a first terminal 400F made of a conductor, a second terminal 500F made of a conductor and the insulator 600E same as that of the terminal 300E. Each of the first terminal 400F, the second terminal 500F and the insulator 600E extends on the plane perpendicular to the Y-direction (second direction). The insulator 600E is fused between the first terminal 400F and the second terminal 500F in the Y-direction to fix and integrate the first terminal 400F and the second terminal 500F.

Referring to FIGS. 30 and 33, the first terminal 400F has the secondary portion 440E and the coupling portion 490E same as those of the first terminal 400E while having a primary portion 410F which is different from the primary portion 410E of the first terminal 400E. The primary portion 410F has the first connection portion (resiliently supporting portion) 420E same as that of the primary portion 410E while not having the first fixed portion 470E. The first connection portion 420E is provided with the first contact portion 412E. The first terminal 400F has a first fixed portion 470F instead of the first fixed portion 470E. The first fixed portion 470F extends rearward from the coupling portion 490E.

The second terminal 500F has a shape that can be obtained by rotating the first terminal 400F by 180° around an axis which is in parallel to the Z-direction (third direction). In detail, the second terminal 500F has the secondary portion 540E and the coupling portion 590E same as those of the second terminal 500E while having a primary portion 510F which is different from the primary portion 510E of the second terminal 500E. The primary portion 510F has the second connection portion (resiliently supporting portion) 560E same as that of the primary portion 510E while not having the second fixed portion 550E. The second connection portion 560E is provided with the second contact portion 542E. The second terminal 500F has a second fixed portion 550F instead of the second fixed portion 550E. The second fixed portion 550F extends forward from the coupling portion 590E.

The first fixed portion 370F of the terminal 300F is formed only of the first fixed portion 470F of the first terminal 400F, and the second fixed portion 350F of the terminal 300F is formed only of the second fixed portion 550F of the second terminal 500F. The first fixed portion 470F and the second fixed portion 550F extend to be apart from each other in the X-direction (front-rear direction).

Figure 34:
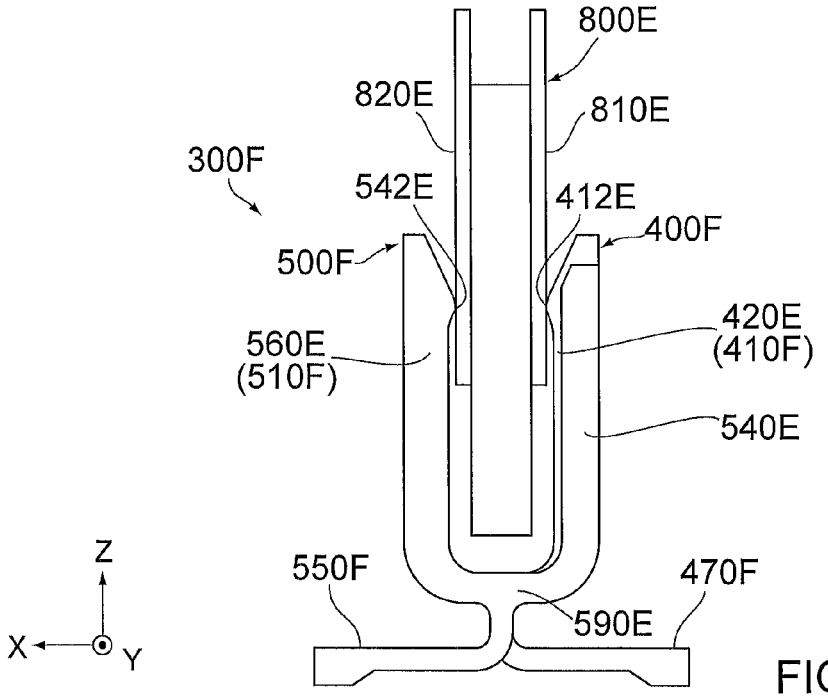
FIG. 34 is a front view showing the terminal of FIG. 33 and a part of the mating connector connected to the terminal.
Figure 35:
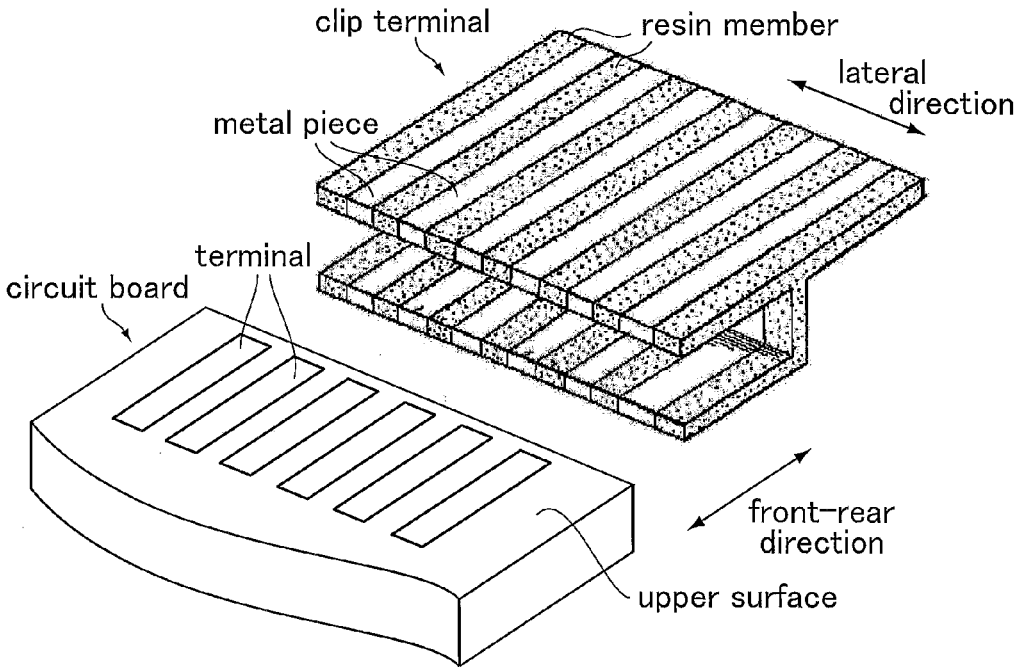
FIG.35 PRIOR ART
FIG. 35 is a perspective view showing a clip terminal and a circuit board of Patent Document 1.

As can be seen from FIG. 34, the terminal 300F is connectable to the mating connector 800E similar to the terminal 300E (see FIG. 31). Moreover, an effect same as that of the terminal 300E can be also obtained by the terminal 300F.

The terminal according to the present invention can be modified variously without being limited to the aforementioned embodiments. For example, the terminal may be press-fit in the housing. Moreover, the terminal may be formed of three or more sub-terminals (for example, the first terminals and the second terminals) which are alternately fixed to one another via the insulators. Moreover, the structures of the terminals according to the aforementioned embodiments can be combined variously.

The present application is based on a Japanese patent application of JP2014-003321 filed before the Japan Patent Office on Jan. 10, 2014, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A terminal connectable to a connection object having a first mating connection portion and a second mating connection portion oppositely located in a first direction, wherein:

the terminal comprises a first terminal, a second terminal and an insulator;

the first terminal has a first contact portion which is to be electrically connected with the first mating connection portion in the first direction;

the second terminal has a second contact portion which is to be electrically connected with the second mating connection portion in the first direction;

the insulator fixes and integrates the first terminal and the second terminal in a second direction perpendicular to the first direction while electrically insulating the first terminal and the second terminal from each other;

the first terminal has a first connection portion at which the first contact portion is provided;

the second terminal has a second connection portion at which the second contact portion is provided;

the insulator fixes the first connection portion and a part of the second terminal to opposite side surfaces of a part of the insulator in the second direction, respectively, and fixes the second connection portion and a part of the first terminal to opposite side surfaces of another part of the insulator in the second direction, respectively; and when the first contact portion and the second contact portion are connected to the first mating connection portion and the second mating connection portion, respectively, the first terminal is electrically unconnected with the second mating connection portion, and the second terminal is electrically unconnected with the first mating connection portion.

2. The terminal as recited in claim 1, wherein:

the first terminal has no part that is to be electrically connected with the second mating connection portion; and the second terminal has no part that is to be electrically connected with the first mating connection portion.

3. The terminal as recited in claim 1, wherein:

the first terminal is to be electrically connected with the first mating connection portion only at the first contact portion; and the second terminal is to be electrically connected with the second mating connection portion only at the second contact portion.

4. The terminal as recited in claim 1, wherein:

the first terminal has no part that overlaps with the second contact portion when seen along the second direction; and the second terminal has no part that overlaps with the first contact portion when seen along the second direction.

5. The terminal as recited in claim 4, wherein:

the first contact portion projects inward in the first direction; and the second contact portion projects inward in the first direction.

6. The terminal as recited in claim 1, wherein the first contact portion and the second contact portion are located at positions same as each other in a third direction perpendicular to both the first direction and the second direction.

7. The terminal as recited in claim 1, wherein the first contact portion and the second contact portion are located at positions different from each other in the second direction.

8. The terminal as recited in claim 1, wherein the first contact portion and the second contact portion are located at positions same as each other in the second direction.

9. The terminal as recited in claim 8, wherein:

one of the first connection portion and the second connection portion has a crank shape when seen along the first direction.

10. The terminal as recited in claim 8, wherein:

the first terminal has a base portion, a protruding portion and a link portion;

the base portion extends along a third direction perpendicular to both the first direction and the second direction;

the protruding portion is apart from the base portion in the second direction;

the link portion links the base portion and the protruding portion in the second direction; and the first contact portion is provided at the protruding portion.

11. The terminal as recited in claim 1, wherein the insulator is fused between the first terminal and the second terminal to integrate the first terminal and the second terminal.

12. The terminal as recited in claim 1, wherein:

one of the first terminal and the second terminal has a resiliently supporting portion which is resiliently deformable; and one of the first contact portion and the second contact portion is supported by the resiliently supporting portion to be movable in the first direction relative to a remaining one of the first contact portion and the second contact portion.

13. The terminal as recited in claim 1, wherein each of the first contact portion and the second contact portion is supported to be unmovable in the first direction.

14. The terminal as recited in claim 1, wherein:

the first terminal has a first fixed portion which is to be fixed to a fixing object to be connected to the fixing object; and the second terminal has a second fixed portion which is to be fixed to the fixing object to be connected to the fixing object.

15. The terminal as recited in claim 14, wherein the first fixed portion and the second fixed portion are to be fixed to the fixing object by soldering.

16. The terminal as recited in claim 14, wherein:

the fixing object extends along a predetermined plane; and the first direction intersects with the predetermined plane.

17. The terminal as recited in claim 16, wherein the first fixed portion and the second fixed portion extend to be apart from each other in a front-rear direction in parallel to the predetermined plane.

18. The terminal as recited in claim 14, wherein:

the fixing object extends along a predetermined plane; and the first direction is a front-rear direction which is in parallel to the predetermined plane.

19. The terminal as recited in claim 18, wherein the first fixed portion and the second fixed portion extend to be apart from each other in the front-rear direction.

20. The terminal as recited in claim 14, wherein the fixing object is a printed circuit board.

21. The terminal as recited in claim 1, wherein the connection object is a printed circuit board.

22. The terminal as recited in claim 1, wherein the connection object is a mating connector.

23. A connector comprising the terminal as recited in claim 1 and a housing, wherein:

the housing is formed with an accommodation portion; and the terminal is partially accommodated in the accommodation portion.

24. A terminal connectable to a connection object having a first mating connection portion and a second mating connection portion oppositely located in a first direction, wherein:

the terminal comprises a first terminal, a second terminal and an insulator;

the first terminal has a first contact portion which is to be electrically connected with the first mating connection portion in the first direction;

the second terminal has a second contact portion which is to be electrically connected with the second mating connection portion in the first direction;

the insulator fixes and integrates the first terminal and the second terminal in a second direction perpendicular to the first direction while electrically insulating the first terminal and the second terminal from each other; and when the first contact portion and the second contact portion are connected to the first mating connection portion and the second mating connection portion, respectively, the first terminal is electrically unconnected with the second mating connection portion, and the second terminal is electrically unconnected with the first mating connection portion;

wherein the first contact portion and the second contact portion are located at positions same as each other in the second direction.

25. The terminal as recited in claim 24, wherein:

the first terminal has a first connection portion at which the first contact portion is provided;

the second terminal has a second connection portion at which the second contact portion is provided; and one of the first connection portion and the second connection portion has a crank shape when seen along the first direction.

26. The terminal as recited in claim 24, wherein:

the first terminal has a base portion, a protruding portion and a link portion;

the base portion extends along a third direction perpendicular to both the first direction and the second direction;

the protruding portion is apart from the base portion in the second direction;

the link portion links the base portion and the protruding portion in the second direction; and the first contact portion is provided at the protruding portion.

* * * * *